US011164514B2

(12) United States Patent
Cho et al.

(10) Patent No.: US 11,164,514 B2
(45) Date of Patent: Nov. 2, 2021

(54) DISPLAY DEVICE INCLUDING INITIALIZATION VOLTAGE SOURCE EXTENDED ALONG DATA LINE

(71) Applicant: Samsung Display Co., LTD., Yongin-si (KR)

(72) Inventors: Young Jin Cho, Seoul (KR); Min Woo Byun, Seongnam-si (KR); Joong Soo Moon, Hwaseong-si (KR); Yang Wan Kim, Hwaseong-si (KR); Han Sol Kim, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/884,578

(22) Filed: May 27, 2020

(65) Prior Publication Data

US 2021/0043134 A1 Feb. 11, 2021

(30) Foreign Application Priority Data

Aug. 5, 2019 (KR) ..... 10-2019-0094680

(51) Int. Cl.

| | |
|---|---|
| ***G09G 5/00*** | (2006.01) |
| ***G09G 3/3208*** | (2016.01) |
| *G09G 3/3233* | (2016.01) |
| *G09G 3/3258* | (2016.01) |

(Continued)

(52) U.S. Cl.

CPC ..... *G09G 3/3208* (2013.01); *G09G 3/3233* (2013.01); *G09G 3/3258* (2013.01); *G09G 3/3266* (2013.01); *G09G 3/3275* (2013.01); *G09G 2300/0408* (2013.01); *G09G 2300/0426* (2013.01); *G09G 2310/0216* (2013.01); *G09G 2310/0286* (2013.01)

(58) Field of Classification Search

CPC ..... G09G 3/3208; G09G 2300/0408; G09G 2300/0426; G09G 3/3233; G09G 3/3258; G09G 3/3266; G09G 3/3275; G09G 2310/0216; G09G 2310/0286

See application file for complete search history.

(56) References Cited

U.S. PATENT DOCUMENTS

2014/0353632 A1* 12/2014 Park ..... H01L 27/3279 257/40
2016/0351120 A1* 12/2016 Itakura ..... G09G 3/3233
2017/0288002 A1* 10/2017 Kim ..... G09G 3/3233

(Continued)

FOREIGN PATENT DOCUMENTS

KR 1020170114028 A 10/2017
KR 1020170131762 A 11/2017

*Primary Examiner* — Adam J Snyder
(74) *Attorney, Agent, or Firm* — Cantor Colburn LLP

(57) ABSTRACT

A display device includes a substrate including a pixel area including a pixel; a peripheral area adjacent to the pixel area; and a boundary between the pixel area and the peripheral area, the boundary comprising a rounded corner; a data driver in the peripheral area; a data line through which a data signal is provided from the data driver to the pixel; and an initialization voltage source in the peripheral area and connected to the pixel, the initialization voltage source extended along the rounded corner of the boundary between the pixel area and the peripheral area. Along the rounded corner of the boundary, the initialization voltage source overlaps the data line along a thickness direction.

21 Claims, 14 Drawing Sheets

(51) Int. Cl.
*G09G 3/3266* (2016.01)
*G09G 3/3275* (2016.01)

(56) References Cited

U.S. PATENT DOCUMENTS

| | | | | |
|---|---|---|---|---|
| 2017/0337873 | A1* | 11/2017 | Kim | G09G 3/3233 |
| 2017/0365214 | A1* | 12/2017 | Tsai | G09G 3/3233 |
| 2018/0006105 | A1* | 1/2018 | Kim | G09G 3/3258 |
| 2018/0075804 | A1* | 3/2018 | Kim | G09G 3/3233 |
| 2018/0158895 | A1* | 6/2018 | Lee | H01L 27/3279 |
| 2018/0190734 | A1 | 7/2018 | Kang et al. | |

* cited by examiner

DISPLAY DEVICE INCLUDING INITIALIZATION VOLTAGE SOURCE EXTENDED ALONG DATA LINE

This application claims priority to Korean Patent Application No. 10-2019-0094680, filed on Aug. 5, 2019, and all the benefits accruing therefrom under 35 U.S.C. § 119, the disclosure of which is incorporated herein by reference in its entirety.

BACKGROUND

1. Field

The present disclosure relates to a display device.

2. Description of the Related Art

As the information-oriented society evolves, various demands for display devices are ever increasing. For example, display devices are being employed by a variety of electronic devices such as smart phones, table personal computers ("PCs"), digital cameras, laptop computers, navigation devices, and smart televisions.

A display device may include a pixel area and a peripheral area which surrounds the pixel area, in a display panel of the display device. Drivers for driving pixel circuitry in the pixel area may be in the peripheral area of the display panel. Signal lines connecting a data driver with pixels in the pixel area may be arranged in a fan-out structure in the peripheral area.

SUMMARY

Embodiments of the present disclosure provide a display device in which a dead space is reduced at corners in a peripheral area of the display device, by disposing initialization voltage sources over signal lines arranged in a fan-out structure.

These and other features, embodiments and advantages of the present disclosure will become immediately apparent to those of ordinary skill in the art upon review of the Detailed Description and Claims to follow.

According to one or more embodiments of the invention, a display device includes a substrate including a pixel area including a pixel; a peripheral area adjacent to the pixel area; and a boundary between the pixel area and the peripheral area, the boundary including a rounded corner; a data driver in the peripheral area; a data line through which a data signal is provided from the data driver to the pixel; and an initialization voltage source in the peripheral area and connected to the pixel, the initialization voltage source extended along the rounded corner of the boundary between the pixel area and the peripheral area. Along the rounded corner of the boundary, the initialization voltage source overlaps the data line along a thickness direction.

The peripheral area of the substrate may include a terminal area and a portion which connects the terminal area to the pixel area. The terminal area may be bendable with respect to a remainder of the peripheral area, and the substrate which is bent may dispose the terminal area overlapping the portion of the peripheral area which connects the terminal area to the pixel area, along the thickness direction.

The data driver may be in the terminal area.

The data line may be provided in plural including a plurality of data lines having a fan-out structure which spreads out in a direction from the data driver toward the pixel area.

The initialization voltage source may overlap the data lines having the fan-out structure.

The initialization voltage source may be provided in plural including a first initialization voltage source and a second initialization voltage source in the peripheral area, and along the rounded corner of the boundary between the pixel area and the peripheral area, the first initialization voltage source and the second initialization voltage source may be parallel to each other at a constant spacing.

The display device may further include a gate insulating layer, a first insulating layer, a second insulating layer and a third insulating layer in order from the substrate.

The first insulating layer may be between the gate insulating layer and the first initialization voltage source, and between the gate insulating layer and the second initialization voltage source.

The display device may further include a first initialization voltage line connected to the pixel area and extended into the peripheral area from the pixel area, and in the peripheral area, a first bridge line which connects the first initialization voltage source to the first initialization voltage line.

The second insulating layer may be between the first bridge line and the first initialization voltage source, and defines a first contact hole, the first insulating layer and the second insulating layer may be between the first bridge line and the first initialization voltage line, and define a second contact hole, the first bridge line may be connected to the first initialization voltage source at the first contact hole, and the first bridge line may be connected to the first initialization voltage line at the second contact hole.

The second initialization voltage source may include an output terminal protruding toward the pixel area.

The display device may further include a second initialization voltage line connected to the pixel area and extended into the peripheral area from the pixel area. The first insulating layer may be between the output terminal of the second initialization voltage source and the second initialization voltage line, and defines a third contact hole, and the output terminal of the second initialization voltage source may be connected to the second initialization voltage line at the third contact hole.

The data line may be provided in plural including a first data line and a second data line each in the peripheral area. In the peripheral area, the gate insulating layer may be between the first data line and the second data line, and the second data line may be between the gate insulating layer and the substrate.

The first data line and the second data line may be extended parallel to each other.

The first data line may be provided in plural including first data lines and the second data line may be provided in plural including second data lines. In the peripheral area, the first data lines and the second data lines may be alternately arranged.

The display device may further include a scan driver and an emission driver in the peripheral area.

The scan driver may be between the emission driver and the pixel area.

The initialization voltage source may be between the scan driver and the pixel area.

The display device may further include a first portion of an emission control line connected to the pixel area and extended into the peripheral area from the pixel area, a second portion of the emission control line connected to the emission driver, and a second bridge line which connects the first portion of the emission control line and the second portion of the emission control line to each other.

The display device may further include a first portion of a scan line connected to the pixel area and extended into the peripheral area from the pixel area, a second portion of the scan line connected to the scan driver, and a third bridge line which connects the first portion of the scan line and the second portion of the scan line to each other.

BRIEF DESCRIPTION OF THE DRAWINGS

The above and other features of the present disclosure will become more apparent by describing in detail exemplary embodiments thereof with reference to the attached drawings, in which.

DETAILED DESCRIPTION

Figure 1:
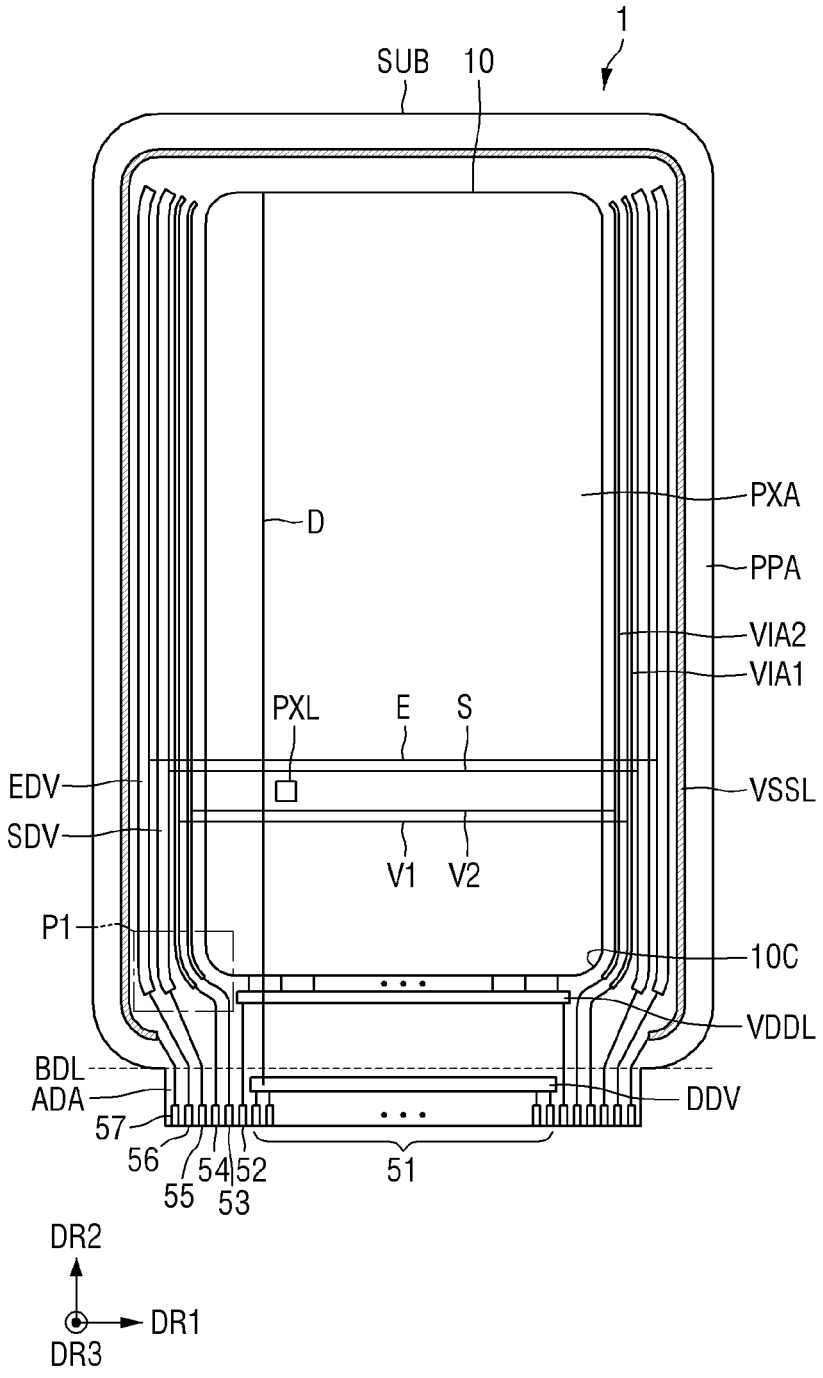
FIG. 1 is a plan view schematically showing an exemplary embodiment of a display device.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the invention disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the invention.

Unless otherwise specified, the illustrated exemplary embodiments are to be understood as providing exemplary features of varying detail of some ways in which the invention may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the invention.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being related to another element such as being "on," "connected to," or "coupled to" another element or layer, it may be directly on, connected to, or coupled to the other element or layer or intervening elements or layers may be present. When, however, an element or layer is referred to as being related to another element such as being "directly on," "directly connected to," or "directly coupled to" another element or layer, there are no intervening elements or layers present. To this end, the term "connected" may refer to physical, electrical, and/or fluid connection, with or without intervening elements.

Further, the X-axis, the Y-axis, and the Z-axis are not limited to three axes of a rectangular coordinate system, such as the x, y, and z axes, and may be interpreted in a broader sense. For example, the X-axis, the Y-axis, and the Z-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be provided or formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of exemplary embodiments may be physically separated into two or more interacting and discrete blocks, units, and/or modules without departing from the scope of the invention. Further, the blocks, units, and/or modules of exemplary embodiments may be physically combined into more complex blocks, units, and/or modules without departing from the scope of the invention.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

In a display device including rounded corners in a plan view, a size or dimension of a dead space may increase toward a lower end of the corners due to a planar area occupied by signal lines extended from a scan driver, an emission driver and/or initialization voltage sources. A variety of line designs may reduce such dead space at the corners.

FIG. 1 is a plan view schematically showing an exemplary embodiment of a display device.

Referring to FIG. 1, a display device 1 may include a display unit 10 disposed on a substrate SUB, a scan driver SDV for providing one or more of an electrical signal such as a scan signal to a pixel PXL provided in plural (e.g., pixels PXL) along a signal line such as a scan line, an emission driver EDV for providing one or more of an electrical signal such as an emission control signal to the pixel PXL along a signal line such as an emission control line, a data driver DDV for providing one or more of an electrical signal such as a data signal to the pixel PXL along a signal line such as a data line, a timing controller TC, a signal line such as a driving voltage supply line VDDL, and a signal line such as a common voltage supply line VSSL. The timing controller TC controls the scan driver SDV, the emission driver EDV, and the data driver DDV. The various drivers mentioned above may drive or control the pixel PXL provided in plural (e.g., pixels PXL), by one or more of the electrical signal, to generate light, emit light, display an image, etc.

The substrate SUB may include or be made of a material such as glass including SiO2, metal and/or organic material. According to an exemplary embodiment of the present disclosure, the substrate SUB may include or be made of a flexible material. In an exemplary embodiment, for example, the substrate SUB may include or be made of, but is not limited to, a flexible plastic material such as polyimide. According to another exemplary embodiment, the plastic material may be polyethersulphone ("PES"), polyacrylate ("PAR"), polyetherimide ("PEI"), polyethylene naphthalate ("PEN"), polyethyelene terepthalate ("PET"), polyphenylene sulfide ("PPS"), polyallylate, polyimide, polycarbonate ("PC"), cellulose triacetate ("TAC"), and cellulose acetate propionate ("CAP"), cyclic olefin polymer, cyclic olefin polymer, etc.

The substrate SUB may be implemented as a single body having a substantially rectangular shape in a plan view. The substrate SUB defines a single and continuous planar area. The substrate SUB and layers which are provided thereon may define a display panel of the display device 1, without being limited thereto.

As a signal line, the display unit 10 may include a scan line S provided in plural (e.g., scan lines S), an emission control line E provided in plural (e.g., emission control lines E), a first initialization voltage line V1 provided in plural (e.g., first initialization voltage lines V1), and a second initialization voltage line V2 provided in plural (e.g., second initialization voltage lines V2) that are lengthwise extended along a first direction DR1. A pixel PXL provided in plural (e.g., pixels PXL) is connected to a corresponding data line D among a plurality of data lines D extended in a second direction DR2 crossing the first direction DR1. Each of pixels PXL may be driven or controlled to emit light, for example, light of red, green, blue or white, where the light is used to display an image. The pixel PXL may include, for example, a light emission element such as an organic light-emitting diode OLED which generates and emits light.

The display device 1 may be disposed in a plane defined by the first direction DR1 and the second direction DR2, without being limited thereto. A third direction DR3 may cross each of the first direction DR1 and the second direction DR2. A thickness of the display device 1 and components thereof may be defined along the third direction DR3.

The substrate SUB includes a pixel area PXA and a peripheral area PPA which is adjacent to the pixel area PXA. The pixel area PXA is a planar area where pixels PXL for displaying images are disposed (e.g., a display area). The pixels PXL will be described later. The peripheral area PPA is a planar area where no pixel PXL is disposed and no image is displayed (e.g., a non-display area). The pixel area PXA and the elements thereof may define the display unit 10, without being limited thereto. The display unit 10 may correspond to the pixel area PXA.

In the peripheral area PPA, one or more driver for driving the pixels PXL and signal (not shown) connecting the pixels PXL with the driver are disposed. The peripheral area PPA corresponds to a bezel of the display device 1 which is completed (e.g., in a final assembled form, manufacturing processes are completed, etc.). A planar dimension (e.g., a width) of the bezel may be determined depending on a corresponding planar dimension (e.g., a width) of the peripheral area. A width of the peripheral area PPA may be taken in a direction from the pixel area PXA to an outer edge of the display device 1, without being limited thereto.

The substrate SUB may have a variety of shapes. In an exemplary embodiment, for example, the substrate SUB may include or define a variety of planar shapes such as a closed polygon including straight sides as an outer edge, a circle and or an ellipse including curved sides as an outer edge, and a semi-circle or a semi-ellipse including straight and curved sides as an outer edge. When the substrate SUB defines or includes a plurality of planar areas, each of the planar areas may be implemented as any of a variety of planar shapes such as a closed polygon including straight sides as a boundary, a circle and or an ellipse including curved sides as a boundary, and a semi-circle or a semi-ellipse including straight and curved sides as a boundary. The boundary may have a rounded corner.

When the substrate SUB is implemented a variety of planar shapes, one or more of the corners of each shape may be a curved line. In an exemplary embodiment, for example, a corner defined by straight lines of straight sides meeting each other meet may be replaced with a corner defined by curved lines having a predetermined curvature. That is to say, opposing ends of a vertex (e.g., corner) of a rectangular shape may be connected to two straight lines adjacent thereto, respectively, and the vertex may be formed or defined by curved lines having a predetermined curvature. The curvature may vary depending on the position. In an exemplary embodiment, for example, the curvature may vary depending on the start position of a curved line (e.g., end thereof) and the length of the curved line. In the following description, the corners of the substrate SUB defined by curved lines are referred to as corners.

The substrate SUB may further include an additional area ADA protruding from one side of the pixel area PXA. The additional area ADA may be otherwise referred to as a pad area, a terminal area, etc. According to an exemplary embodiment of the present disclosure, the additional area ADA may have a planar shape protruding from a horizontal portion of the peripheral area PPA. The additional area ADA may be bendable with respect to a boundary of the additional area ADA with the horizontal portion of the peripheral area PPA. The additional area ADA may be bendable with respect to a bending line BDL. Since the additional area ADA is bendable, such as to be disposed overlapping with the horizontal portion of the peripheral area PPA, the width of the bezel at the horizontal portion of the peripheral area PPA can be reduced.

The data driver DDV may be disposed in the additional area ADA. It is to be understood that elements that may be disposed in the additional area ADA are not limited thereto. According to an exemplary embodiment of the present disclosure, the additional area ADA may be disposed at or extended from other portion of the peripheral area PPA as well as that shown in FIG. 1 and can reduce the width of the bezel of the display device 1 by being bent to overlap with the other portion of the peripheral area PPA. That is, the substrate SUB which is bent disposes the additional area ADA overlapping a portion of the peripheral area PPA excluding the additional area ADA, along the thickness direction.

The pixel area PXA has a shape corresponding to a shape of the substrate SUB. Referring to FIG. 1, a profile of the corners (e.g., rounded or curved) and the sides which connect corners to each other, of the substrate SUB, corresponds to a profile of respective corners and sides of the pixel area PXA.

The peripheral area PPA is disposed on or extended from at least one side of the pixel area PXA. According to an exemplary embodiment of the present disclosure, the peripheral area PPA may surround the pixel area PXA in the plan view. According to an exemplary embodiment of the present disclosure, the peripheral area PPA may include a horizontal portion lengthwise extended along a width direction (e.g., along the first direction DR1) of the display device 1, and a vertical portion lengthwise extended along the longitudinal direction (e.g., along the second direction DR2) of the display device 1. A pair of vertical portions of the peripheral area PPA is disposed opposing each other and spaced apart from each other along the width direction with respect to the pixel area PXA.

The pixels PXL are disposed on the pixel area PXA of the substrate SUB. Each of the pixels PXL may be a minimum unit with which light is emitted, an image is displayed, etc., and more than one of the pixel PXL may be disposed in the pixel area PXA. Each of the pixels PXL may include an organic light-emitting element which generates and/or emits white light and/or color light. Each pixel PXL may emit one of red, green, and blue light, but the present disclosure is not limited thereto. Each pixel PXL may emit light of colors such as cyan, magenta and yellow.

The pixels PXL may be arranged in a matrix along rows extended along the first direction DR1 and columns extended along the second direction DR2. However, the arrangement of the pixels PXL is not particularly limited thereto and may be arranged in a variety of forms. In an exemplary embodiment, for example, a first portion of the pixels PXL may be arranged such that the first direction DR1 is the row direction, but a second portion of the pixels PXL different from the first portion thereof may be arranged in a direction different from the first direction DR1, e.g., a direction oblique or inclined relative to the first direction DR1 as the row direction.

The scan driver SDV may be disposed in the vertical portion of the peripheral area PPA. As a pair of vertical portions of the peripheral area PPA is disposed spaced apart along the width direction of the pixel area PXA, the scan driver SDV may be disposed on at least one of the vertical portions of the peripheral area PPA. The scan driver SDV may be lengthwise extended along the longitudinal direction of the peripheral area PPA.

According to an exemplary embodiment of the present disclosure, the scan driver SDV may be mounted directly on the substrate SUB. When the scan driver SDV is directly mounted on the substrate SUB, the scan driver SDV may be provided or formed together during a process of providing or forming the pixels PXL. However, the position and/or the method of forming the scan driver SDV is not limited thereto. The scan driver SDV may be provided or formed on a chip separate from the substrate SUB and may be provided on or connected to the substrate SUB such as a chip-on-glass. Alternatively, the scan driver SDV may be mounted on a printed circuit board separate from the substrate SUB and be connected to the substrate SUB through a connection member.

The emission driver EDV may also be disposed in the vertical portion of the peripheral area PPA, like the scan driver SDV. The emission driver EDV and the scan driver SDV may be disposed in a same vertical portion. The emission driver EDV may be disposed on at least one of the vertical portions of the peripheral area PPA. The emission driver EDV may be lengthwise extended in the longitudinal direction of the peripheral area PPA.

According to an exemplary embodiment of the present disclosure, the emission driver EDV may be mounted directly on the substrate SUB. When the emission driver EDV is mounted directly on the substrate SUB, the emission driver EDV may be provided or formed together with the pixels PXL during a same process of providing or forming the pixels PXL. However, the position and/or the method of providing or forming the emission driver EDV is not limited thereto. The emission driver EDV may be provided or formed on a separate chip and connected to the substrate SUB as a chip-on-glass. Alternatively, the emission driver EDV may be mounted on a printed circuit board to be connected to the substrate SUB through a connection member.

According to an exemplary embodiment of the present disclosure, the scan driver SDV and the emission driver EDV are adjacent to each other within a same vertical portion of the peripheral area. A pair of the scan driver SDV and the emission driver EDV are provided on both of the vertical portions of the peripheral area PPA as an example, but the present disclosure is not limited thereto. The arrangement may be altered in a variety of ways. In an exemplary embodiment, for example, the scan driver SDV may be disposed at one of the vertical portions of the peripheral area PPA, while the emission driver EDV may be disposed at another one of the vertical portions of the peripheral area PPA (e.g., in different vertical portions from each other). Alternatively, the scan driver SDV may be disposed at both of the vertical portions of the peripheral area PPA, while the emission driver EDV may be disposed only at one of the vertical portions of the peripheral area PPA.

The data driver DDV may be disposed in the peripheral area PPA. In particular, the data driver DDV may be disposed in the horizontal portion of the peripheral area PPA. The data driver DDV may be lengthwise extended in the width direction of the peripheral area PPA.

According to an exemplary embodiment of the present disclosure, the positions of the scan driver SDV, the emission driver EDV and/or the data driver DDV may be interchanged as necessary.

The timing controller TC may be connected to the scan driver SDV, the emission driver EDV and the data driver DDV through a conductive line and/or a signal line provided in plural (e.g., lines) in a variety of ways. The position of the timing controller TC is not particularly limited herein. In an exemplary embodiment, for example, the timing controller TC may be mounted on a printed circuit board of the display device 1 and may be connected to the scan driver SDV, the emission driver EDV and the data driver DDV through a flexible printed circuit board of the display device 1. The printed circuit board may be disposed at a variety of positions such as corresponding to one side of the substrate SUB in a plan view thereof or facing a rear surface of the substrate SUB.

A terminal unit is disposed at one end of the substrate SUB and includes a plurality of terminals 51, 52, 53, 54, 56 and 57. The terminal unit is disposed on the additional area ADA, for example, to define the additional area ADA as a terminal area. The peripheral area PPA of the substrate SUB includes the terminal area having a smaller width than a remainder of the substrate SUB, along the first direction DR1. As the additional area ADA, the terminal area of the peripheral area PPA may be bendable with respect to a remainder of the peripheral area PPA of the substrate SUB.

The terminal unit may not be covered by an insulating layer of the display device 1 to be exposed, and may be electrically connected to a controller (not shown) such as a flexible printed circuit board and/or an integrated circuit ("IC") chip. The controller converts an electrical signal such as image signals transmitted from outside the display panel into an electrical signal such as image data signals and transfers the converted electrical signals to the data driver DDV through the terminal 51. In addition, the controller may receive a vertical synchronization signal, a horizontal synchronization signal and a clock signal as electrical signals, to generate a control signal for controlling the driving of the scan driver SDV, the emission driver EDV and the data driver DDV to transfer such electrical signals to the scan driver SDV, the emission driver EDV and the data driver DDV, through terminals 51, 55 and 56. The controller transmits electrical signals such as a first initialization voltage and a second initialization voltage to the first initialization voltage line V1 and the second initialization voltage line V2 through the terminals 53 and 54, respectively. The controller transfers the driving voltage (e.g., first supply voltage ELVDD) and the common voltage (e.g., second supply voltage ELVSS) as electrical signals to the driving voltage supply line VDDL and the common voltage supply line VSSL through the terminals 52 and 57, respectively.

A first initialization voltage source VI1 is disposed on the peripheral area PPA and provides a first initialization voltage to one electrode of a fourth transistor of a pixel PXL. That is, the first initialization voltage source VI1 is connected to the pixel PXL. A second initialization voltage source Vint2 is disposed on the peripheral area PPA and provides a second initialization voltage to one electrode of a seventh transistor of a pixel PXL. That is, the second initialization voltage source Vint2 is connected to the pixel PXL.

According to an exemplary embodiment of the present disclosure, the first and second initialization voltage sources Vint1 and Vint2 may be disposed in the vertical portions of the peripheral area PPA. Among a pair of vertical portions of the peripheral area PPA spaced apart from each other along the width direction of the pixel area PXA, the first and second initialization voltage sources Vint1 and Vint2 may each be disposed in both of the vertical portions of the peripheral area PPA. The first and second initialization voltage sources Vint1 and Vint2 may be lengthwise extended along the longitudinal direction of the peripheral area PPA.

The driving voltage supply line VDDL is disposed on the peripheral area PPA. In an exemplary embodiment, for example, the driving voltage supply line VDDL may be disposed between the data driver DDV and the display unit 10. The driving voltage supply line VDDL provides the driving voltage to the pixels PXL.

The common voltage supply line VSSL is disposed on the peripheral area PPA and provides a common voltage to the cathode electrode of the organic light-emitting element of the pixel PXL. In an exemplary embodiment, for example, the common voltage supply line VSSL may be lengthwise extended along an edge of the substrate SUB except for the terminal unit in a loop shape having one side open (e.g., a side corresponding to the additional area ADA).

The display unit 10 has a substantially quadrangular planar shape and a boundary thereof includes one or more of a rounded corner 10C. The boundary may be defined between the pixel area PXA and the peripheral area PPA, without being limited thereto. The ends of the scan driver SDV, the emission driver EDV, the first initialization voltage source VI1, the second initialization voltage source Vint2 and the common voltage supply line VSSL may be curved along the corners 10C of the display unit 10. In an exemplary embodiment, along the rounded corner 10C of the boundary, the first initialization voltage source VI1 and the second initialization voltage source Vint2 are arranged parallel to each other at a constant spacing therebetween.

Figure 2:
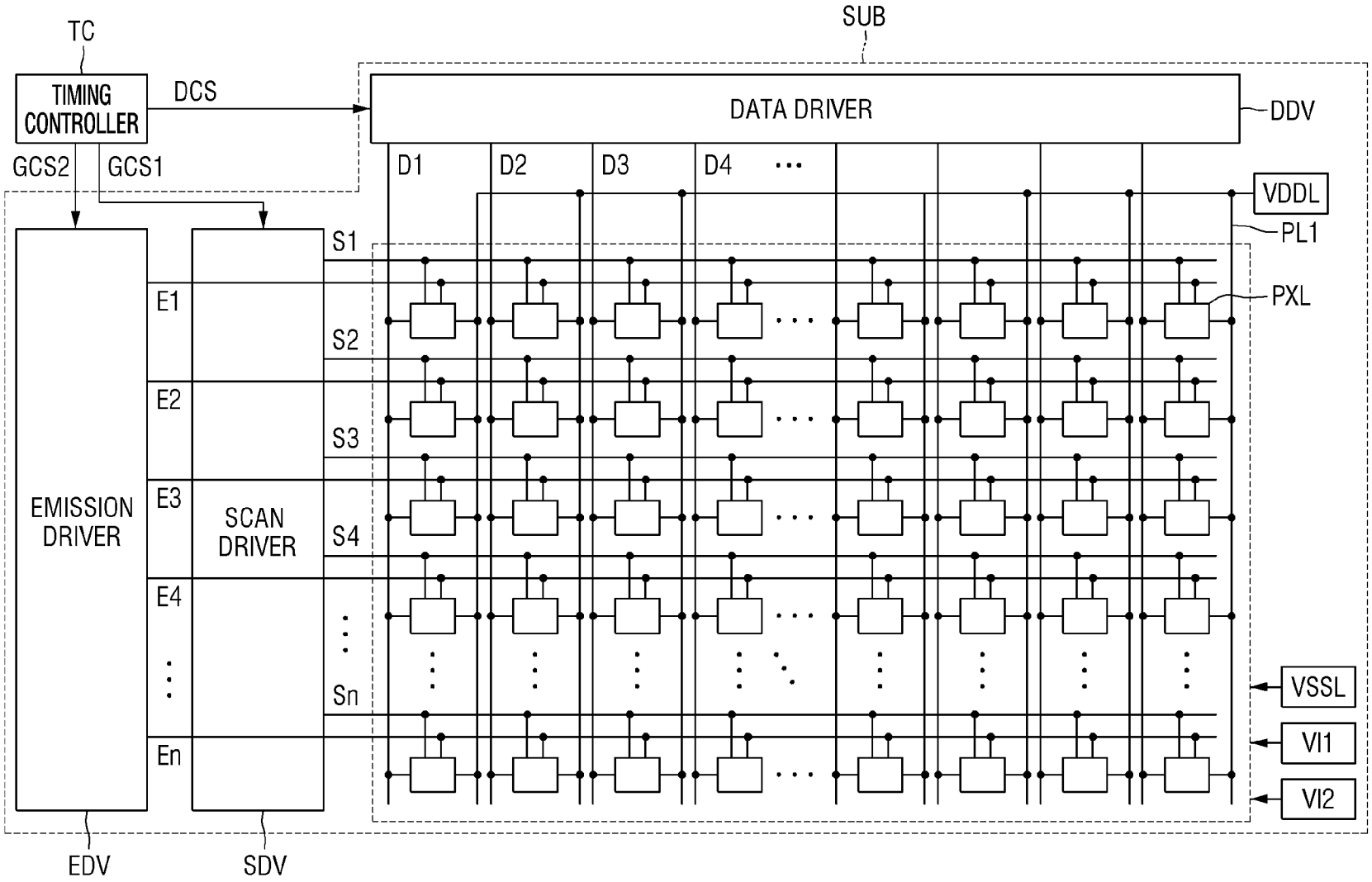
FIG. 2 is a block diagram showing an exemplary embodiment of pixels and drivers.

FIG. 2 is a block diagram showing an exemplary embodiment of pixels PXL and drivers on a single one of the substrate SUB.

Referring to FIG. 2, a display device 1 according to according to an exemplary embodiment of the present disclosure includes pixels PXL, drivers, and lines (e.g., conductive lines, signal lines, etc.).

A plurality of pixels PXL is provided in a display unit 10, such as indicated by the dotted line in FIG. 2. The drivers include a scan driver SDV, an emission driver EDV, a data driver DDV and a timing controller TC. In FIG. 2, the locations of the scan driver SDV, the emission driver EDV, the data driver DDV and the timing controller TC are shown for convenience of illustration, and may be disposed at other locations within the display device 1 in practice.

The lines provides a signal to each pixel PXL from the drivers, and include scan lines S, data lines D, emission control lines E, a power line PL provided in plural (e.g., power lines PL), and first and second initialization power lines (not shown). The scan lines S include a plurality of scan lines S1 to Sn, and the emission control lines E include a plurality of emission control lines E1 to En. The data lines D1 to Dm and the power line PL are connected to the pixels PXL. The pixels PXL are positioned in the pixel area PXA. The pixels PXL are connected to scan lines S1 to Sn, emission control lines E1 to En, data lines D1 to Dm, and first and second initialization power lines (not shown). The pixels PXL receive a data signal from the data lines D1 to Dm when a scan signal is supplied from the scan lines S1 to Sn. The pixels PXL receiving the data signal control the amount of electrical current flowing from the first supply voltage ELVDD to the second supply voltage ELVSS via an organic light-emitting element (not shown).

The scan driver SDV supplies scan signals to the scan lines S1 to Sn in response to a first gate control signal GCS1 from the timing controller TC. In an exemplary embodiment, for example, the scan driver SDV may sequentially supply scan signals to the scan lines S1 to Sn. By sequentially supplying scan signals to the scan lines S1 to Sn, the pixels PXL on the same horizontal line are selected sequentially.

The emission driver EDV supplies emission control signals to the emission control lines E1 to En in response to a second gate control signal GCS2 from the timing controller TC. In an exemplary embodiment, for example, the emission driver EDV may sequentially supply emission control signals to emission control lines E1 to En.

The emission control signals may have a width larger than the scan signals. In an exemplary embodiment, for example, the emission control signal supplied to the $i^{th}$ emission control line Ei may overlap with the scan signal supplied to the $(i-1)^{th}$ scan line S(i−1) and the scan signal supplied to the $i^{th}$ scan line Si, for at least a period of time.

In addition, the emission control signal may be set to a gate-off voltage (e.g., a high-level voltage) so that the transistors included in the pixels PXL can be turned off, while the scan signal may be set to a gate-on voltage (e.g., a low-level voltage) so that the transistors included in the pixels PXL can be turned on.

The data driver DDV supplies data signals to the data lines D1 to Dm in response to the data control signal DCS. The data signals supplied to the data lines D1 to Dm are supplied to the pixels PXL selected by the scan signal.

The timing controller TC supplies the gate control signals GCS1 and GCS2 generated based on timing signals supplied from an external device relative to the scan drivers SDV and the emission drivers EDV, and the data control signals DCS, to the data driver DDV.

Each of the gate control signals GCS1 and GCS2 includes a start pulse and clock signals. The start pulse is used to control the timing of a first scan signal or a first emission control signal. Clock signals are used to shift the start pulse.

The data control signal DCS includes a source start pulse and clock signals. The source start pulse is used control the start point of sampling of the data. Clock signals are used to control the sampling operation.

Figure 3:
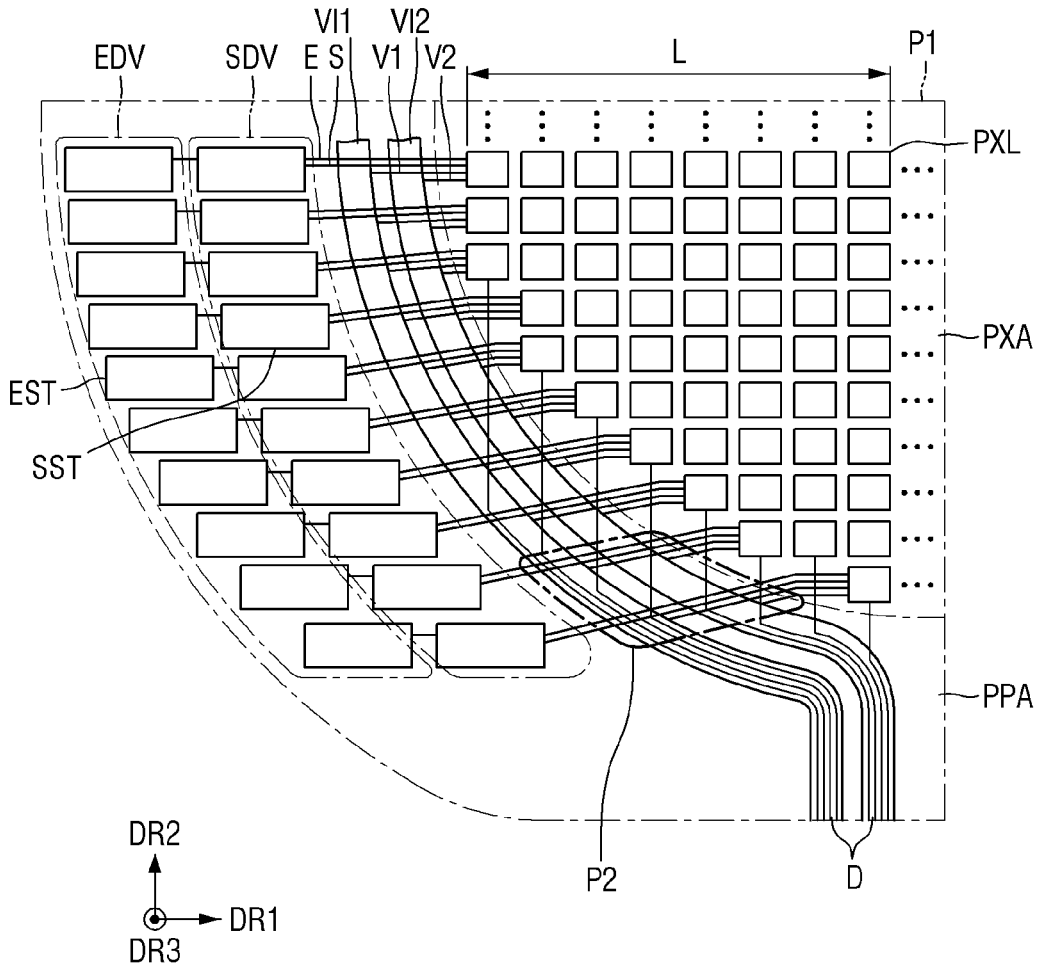
FIG. 3 is an enlarged plan view showing an exemplary embodiment of portion P1 of FIG. 1.
Figure 4:
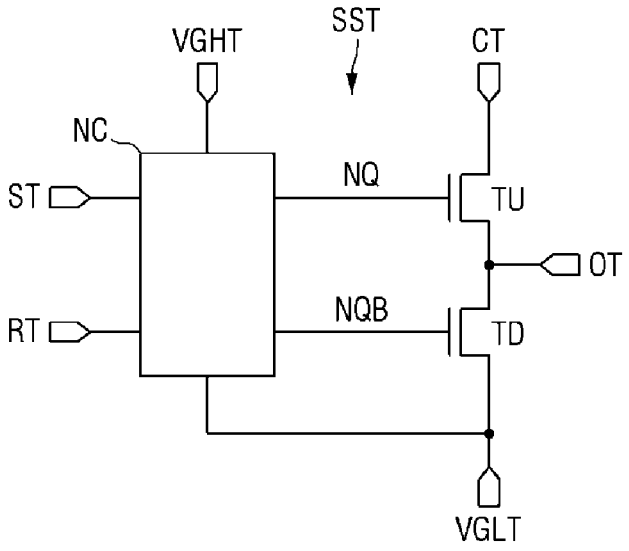
FIG. 4 is a circuit diagram illustrating an exemplar embodiment of scan stages of FIG. 3.

FIG. 3 is an enlarged plan view showing an exemplary embodiment of portion P1 of FIG. 1 including a connective relationship between the pixels PXL, the lines and the drivers. The planar area denoted by P1 in FIG. 1 is a part of the lower end of the pixel area PXA and a part of the lower end of the peripheral area PPA. FIG. 4 is a circuit diagram illustrating an exemplary embodiment of scan stages of FIG. 3.

In FIG. 3, for convenience of illustration of the relationship between the lines, one of the scan lines S connected to a single pixel PXL and a single one of an emission control line E are illustrated as an example, which are denoted by "scan line S" and "emission control line E," respectively. In addition, only a portion of the data lines D and the power lines are depicted, where the data lines are denoted by "data lines D". Referring to FIG. 3, the substrate is divided into a pixel area PXA and a peripheral area PPA, and the pixels PXL are disposed in the pixel area PXA.

Pixel rows each including pixels PXL, may be extended along the first direction DR1 and arranged along the second direction DR2 so that the pixel rows are parallel to the first direction DR1. Pixel columns each including pixels PXL, may be extended along the second direction DR2 and arranged along the first direction DR1 so that the pixel columns are parallel to the second direction DR2. That is to say, the pixels PXL may be arranged in a matrix. The pixels PXL will be described later.

A boundary of the pixel area PXA has straight and curved sides, and rounded corners. The substrate SUB may have a rounded corner corresponding to the rounded corner 10C of the display unit 10 and/or the rounded corner of the boundary between the pixel area PXA and the peripheral area PPA. The pixel area PXA may include a rounded corner corresponding to the rounded corner of the display unit 10 and/or the substrate SUB.

Assuming that an axis parallel to the first direction DR1 is the x-axis, in the pixel area PXA other than the corners, positions of the outermost pixel PXL along the x-axis and the number of the pixels PXL of each of the pixel rows are all equal. In FIG. 3, the top three pixel rows illustrated have the leftmost pixels PXL (e.g., outermost being closest to the peripheral area PPA) aligned with each other along the second direction DR2. Such position of the outermost pixel PXL along the first direction DR1 may be considered a reference or reference position. Accordingly, the pixel rows corresponding to an area of the peripheral area PPA along the second direction DR2, except for the corner, have the same length L along the first direction DR1.

In contrast, in an area corresponding to the corners of the pixel area PXA, the number of the pixels PXL of each of the pixel rows is reduced or decreases along the second direction DR2 toward the additional area ADA. The positions of the outermost pixels PXL of the pixel rows along the x-axis become further from a reference, e.g., the position of the outermost pixel PXL of each of the pixel rows disposed in the pixel area PXA other the corners. In other words, the pixel rows closer to the lower side of the display device 1 (e.g., away from a center of the pixel area PXA) along the second direction DR2 have lengths L along the first direction DR1 which decrease, such that a boundary of a planar area of the pixel area PXA can have rounded corners. Accordingly, different pixel rows corresponding to the corners of the pixel area PXA may have different numbers of pixels PXL therein. At the corners of the pixel area PXA, as the pixel row is closer to the center of the pixel area PXA, the more pixels PXL the pixel row may include.

Although only one side of the pixel area PXA (e.g., left side in FIG. 1) is shown for convenience of illustration, it is to be understood that the other side thereof (e.g., right in FIG. 1) may be provided or formed in the same manner so that the shape of the pixel area PXA is symmetrical about a center axis extended along the second direction DR2. The lengths L of the pixel rows along the first direction DR1 decreases as a distance of the pixel rows from the center of the pixel area PXA decrease, but the lengths L may not decrease at the same ratio (or the number of pixels PXL arranged in the pixel row at the same ratio). The numbers of pixels PXL arranged in each pixel row may vary depending on the curvature of the corners of the pixel area PXA.

The drivers may be disposed in the peripheral area PPA, and the lines may connect the pixels PXL with the drivers.

The driver includes a scan driver SDV connected to the pixels PXL through scan lines S. The scan driver SDV is disposed adjacent to the pixel area PXA.

The scan driver SDV according to the exemplary embodiment of the present disclosure includes a scan stage SST provided in plural (e.g., a plurality of scan stages SST). Each of the scan stages SST is connected to one of the scan lines S. The scan lines S connect the output terminals of the scan stages SST with the scan signal input terminals of the outermost pixels PXL of the pixel rows. The scan stages SST are driven upon receiving a clock signal. Such scan stages SST may be implemented in substantially a same circuit.

The scan driver SDV may have a boundary having curved shape corresponding to the corner of the pixel area PXA. In an exemplary embodiment, for example, the scan stages SST may be arranged along the edge of the pixel area PXA. Accordingly, an imaginary line (e.g., dotted line in FIG. 3) connecting the ends of the scan stages SST may have a curved shape having a predetermined curvature.

The scan stages SST may be associated with the pixel rows of the pixel area PXA, respectively, and may supply scan signals to the pixels PXL arranged in the pixel rows.

As shown in FIG. 4, the scan driver SDV may include a plurality of scan stages SST that are cascaded, and the scan stages SST may sequentially output scan signals to the scan lines S.

As shown in FIG. 4, each of the scan stages SST includes a pull-up node NQ, a pull-down node NQB, a pull-up transistor TU that is turned on when the pull-up node NQ has a gate-on voltage, a pull-down transistor TD that is turned on when the pull-down node NQB has a gate-on voltage, and a node controller NC for controlling charge/discharge of the pull-up node NQ and the pull-down node NQB.

The node controller NC may be connected to a start terminal ST to which a start signal or an output signal from the previous stage is input, a reset terminal RT to which an output signal from the subsequent stage is input, a gate-on voltage terminal VGHT to which a gate-on voltage is applied, and a gate-off voltage terminal VGLT to which a gate-off voltage is applied. The node controller NC controls charging and discharging of the pull-up node NQ and the pull-down node NQB according to the start signal or the output signal from the previous stage input to the start terminal ST. In order to control the output from the stages SST stably, the node controller NC causes the pull-down node NQB to have a gate-off voltage when the pull-up node NQ has a gate-on voltage, and the pull-up node NQ to have a gate-off voltage when the node NQB has a gate-on voltage. To this end, the node controller NC may include a plurality of transistors.

The pull-up transistor TU is turned on when the scan stage SST is pulled up, that is, when the pull-up node NQ has the gate-on voltage, to output a clock signal input to the clock signal CT to the output terminal OT. The pull-down transistor TD is turned on when the scan stage SST is pulled down, that is, when the pull-down node NQB has the gate-on voltage, to output a gate-off voltage at the gate-off voltage terminal VGLT to the output terminal OT.

The pull-up transistor TU and the pull-down transistor TD of the scan driver SDV and the plurality of transistors of the node controller NC may be implemented as thin-film transistors. Although the pull-up transistor TU, the pull-down transistor TD of the scan stage SST and the plurality of transistors of the node controller NC are implemented as n-type semiconductor transistors having n-type semiconductor characteristics in the example shown in FIG. 4, exemplary embodiments of the present disclosure are not limited thereto. In an exemplary embodiment, for example, the pull-up transistor TU and the pull-down transistor TD of the scan driver SDV and the plurality of transistors of the node controller NC may be implemented as p-type semiconductor transistors having p-type semiconductor characteristics.

Referring back to FIG. 3, the scan lines S disposed in the pixel area PXA may be parallel to the first direction DR1. The scan lines S in the peripheral area PPA may be parallel to the first direction DR1 or inclined with respect to the first direction DR1. As the corners of the peripheral area PPA are curved, the scan stages SST are also arranged along the curved corners of the peripheral area PPA. As a result, the scan lines S in the peripheral area PPA may be bent at a certain location and may have an angle inclined with respect to the first direction DR1. The scan lines S are bent since the locations at the output terminals of the scan stages SST are different from locations at the scan signal input terminals of the outermost pixels PXL of the pixel rows.

The driver also includes an emission driver EDV connected to the pixels PXL, and the emission driver EDV is adjacent to the scan driver SDV. The scan driver SDV may be positioned between the emission driver EDV and the pixel area PXA. Accordingly, the emission driver EDV may be disposed more to the outside (e.g., further from the pixel area PXA) than the scan driver SDV.

According to the exemplary embodiment of the present disclosure, the emission driver EDV includes an emission stage EST provided in plural (e.g., a plurality of emission stages EST). The emission control lines E connect the output terminals of the emission stages EST with the scan signal input terminals of the outermost pixels PXL of the pixel rows. The scan stages SST are driven upon receiving a clock signal. Such emission stages EST may be implemented in substantially a same circuit.

The emission driver EDV may have a curved shape corresponding to the corner of the pixel area PXA. In an exemplary embodiment, for example, an imaginary line connecting the ends of the emission stages EST (e.g., dotted line in FIG. 3) may have a curved shape having a predetermined curvature.

The emission stages EST may be associated with the pixel rows of the pixel area PXA, respectively, and may supply emission control signals to the pixels PXL arranged in the pixel rows.

The emission control lines E disposed in the pixel area PXA may be parallel to the first direction DR1. The emission control lines E in the peripheral area PPA may be parallel to the first direction DR1 or inclined with respect to the first direction DR1. First ends of the emission control lines E disposed in the peripheral area PPA are connected to the pixels PXL, and second ends of the emission control lines E opposite to the first ends thereof are connected to the emission stages EST. As a boundary at the corners of the peripheral area PPA are curved, the emission stages EST are also arranged along the curved corners of the peripheral area PPA. As a result, the emission control lines E in the peripheral area PPA may be bent at a certain location and may have an angle inclined with respect to the first direction DR1. The emission control lines E are bent since the locations at the output terminals of the emission stages EST are different from locations at the scan signal input terminals of the outermost pixels PXL of the pixel rows.

Although the scan lines S and the emission control lines E are connected to only the outermost pixels PXL of the pixel rows in the example shown in FIG. 3 for convenience of illustration, the scan lines S are connected to all of the pixels PXL included in the pixel rows. Likewise, the emission control lines E are connected to all of the pixels PXL provided in the pixel rows.

Next, the data driver DDV (see FIG. 1) may be disposed in the horizontal portion of the additional area ADA. Data lines D associated with the pixel columns may be connected thereto, respectively. The data lines D are connected to the data driver DDV. Although the data lines D are connected to only the outermost pixels PXL of the pixel columns in the example shown in FIG. 3 for convenience of illustration, the data lines D are connected to all of the pixels PXL included in the pixel columns. The pixels PXL in a same column may share a same one of the data line D. The data lines D in the pixel area PXA are extended along the second direction DR2. The data lines D are extended in the peripheral area PPA generally along the second direction DR2. However, the data lines D may be bent in a certain location and may be extended in a direction inclined with respect to the second direction DR2.

The data lines D may be extended such that distances therebetween decrease in a direction toward the data driver DDV and may form a fan-out structure of the data lines D, e.g., the data lines D spread apart from each other in a direction from the data driver DDV toward the pixels PXL. Referring to FIG. 3, for example, a first portion of the data lines D corresponds to the first initialization voltage source VI1, and distances between end portions of the data lines D increase in a direction toward the pixels PXL to define a fan-out structure. Similarly, a second portion of the data lines D corresponds to the second initialization voltage source Vint2, and distances between end portions of the data lines D increase in a direction toward the pixels PXL to define a fan-out structure.

A power line PL provided in plural (e.g., power lines PL) associated with the pixel columns, respectively, may be connected thereto. The power lines PL supply the first supply voltage ELVDD (see FIG. 2) to the pixels PXL. Although first power lines PL1 are connected to only the outermost pixels PXL of the pixel columns in the example shown in FIG. 2 for convenience of illustration, the first power lines PL1 are connected to all of the pixels PXL included in the pixel columns. The pixels PXL in a same column may share the same first power line PL1.

Next, the pixels PXL shown in FIG. 3 will be described.

Figure 5:
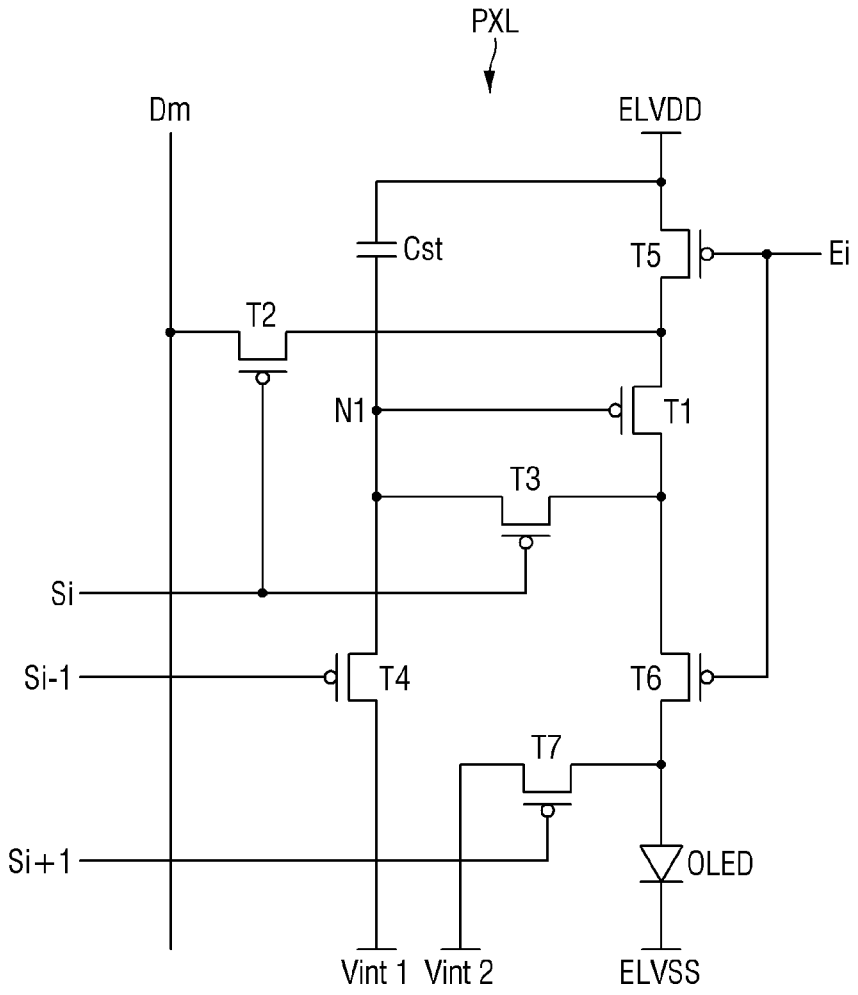
FIG. 5 is a diagram showing an exemplary embodiment of a pixel shown in FIG. 3.

FIG. 5 is a diagram showing an exemplary embodiment of a pixel PXL shown in FIG. 3. For convenience of illustration, FIG. 5 shows the pixel PXL connected to the $m^{th}$ data line Dm and the $i^{th}$ scan line Si.

Referring to FIG. 5, a pixel PXL according to an exemplary embodiment of the present disclosure includes an organic light-emitting diode OLED, first to seventh transistors T1 to T7, and a storage capacitor Cst.

The anode of the organic light-emitting diode OLED is connected to the first transistor T1 via the sixth transistor T6, and the cathode thereof is connected to the second supply voltage ELVSS. The organic light-emitting diode OLED generates light having a predetermined luminance in proportional to the amount of electrical current supplied from the first transistor T1.

The first supply voltage ELVDD may be set to a higher voltage than the second supply voltage ELVSS so that an electrical current can flow to the organic light-emitting diode OLED.

The seventh transistor T7 is connected between the second initialization voltage source Vint2 and the anode of the organic light-emitting diode OLED. The gate electrode of the seventh transistor T7 is connected to the $(i+1)^{th}$ scan line S(i+1). The seventh transistor T7 is turned on when a scan signal is supplied to the $(i+1)^{th}$ scan line S(i+1) to transfer the voltage of the second initialization voltage source Vint2 (e.g., second initialization voltage Vint2) to the anode of the organic light-emitting diode OLED. The second initialization voltage Vint2 may be set to a voltage lower than the second supply voltage ELVSS.

The sixth transistor T6 is connected between the first transistor T1 and the organic light-emitting diode OLED. The gate electrode of the sixth transistor T6 is connected to the $i^{th}$ emission control line Ei. The sixth transistor T6 is turned off when an emission control signal is supplied to the $i^{th}$ emission control line Ei, and is turned on otherwise.

The fifth transistor T5 is connected between the first supply voltage ELVDD and the first transistor T1. The gate electrode of the fifth transistor T5 is connected to the $i^{th}$ emission control line Ei. The fifth transistor T5 is turned off when an emission control signal is supplied to the $i^{th}$ emission control line Ei, and is turned on otherwise.

The first electrode of the first transistor T1 (driving transistor) is connected to the first supply voltage ELVDD via the fifth transistor T5, and the second electrode thereof is connected to the anode of the organic light-emitting diode OLED via the sixth transistor T6. The gate electrode of the first transistor T1 is connected to the first node N1. The first transistor T1 controls the amount of electrical current flowing from the first supply voltage ELVDD to the second supply voltage ELVSS via the organic light-emitting diode OLED in proportion to the voltage of the first node N1.

The third transistor T3 is connected between the second electrode of the first transistor T1 and the first node N1. In addition, the gate electrode of the third transistor T3 is connected to the $i^{th}$ scan line Si. The third transistor T3 is turned on when a scan signal is supplied to the $i^{th}$ scan line Si to electrically connect the second electrode of the first transistor T1 with the first node N1. Therefore, when the third transistor T3 is turned on, the first transistor T1 is diode-connected.

The fourth transistor T4 is connected between the first node N1 and the first initialization voltage source VI1. In addition, the gate electrode of the fourth transistor T4 is connected to the $(i-1)^{th}$ scan line S(i−1). The fourth transistor T4 is turned on when a scan signal is supplied to the $(i-1)^{th}$ scan line S(i−1) to supply the voltage of the first initialization voltage source VI1 (e.g., first initialization voltage Vint1) to the first node N1. The first initialization voltage Vint1 may be set to a voltage lower than the data signal.

The second transistor T2 is connected between the $m^{th}$ data line Dm and the first electrode of the first transistor T1. In addition, the gate electrode of the second transistor T2 is connected to the $i^{th}$ scan line Si. The second transistor T2 is turned on when a scan signal is supplied to the $i^{th}$ scan line Si to electrically connect the $m^{th}$ data line Dm with the first electrode of the first transistor T1.

The storage capacitor Cst is connected between the first supply voltage ELVDD and the first node N1. The storage capacitor Cst stores a voltage equal to the data signal and the threshold voltage of the first transistor T1.

Figure 6:
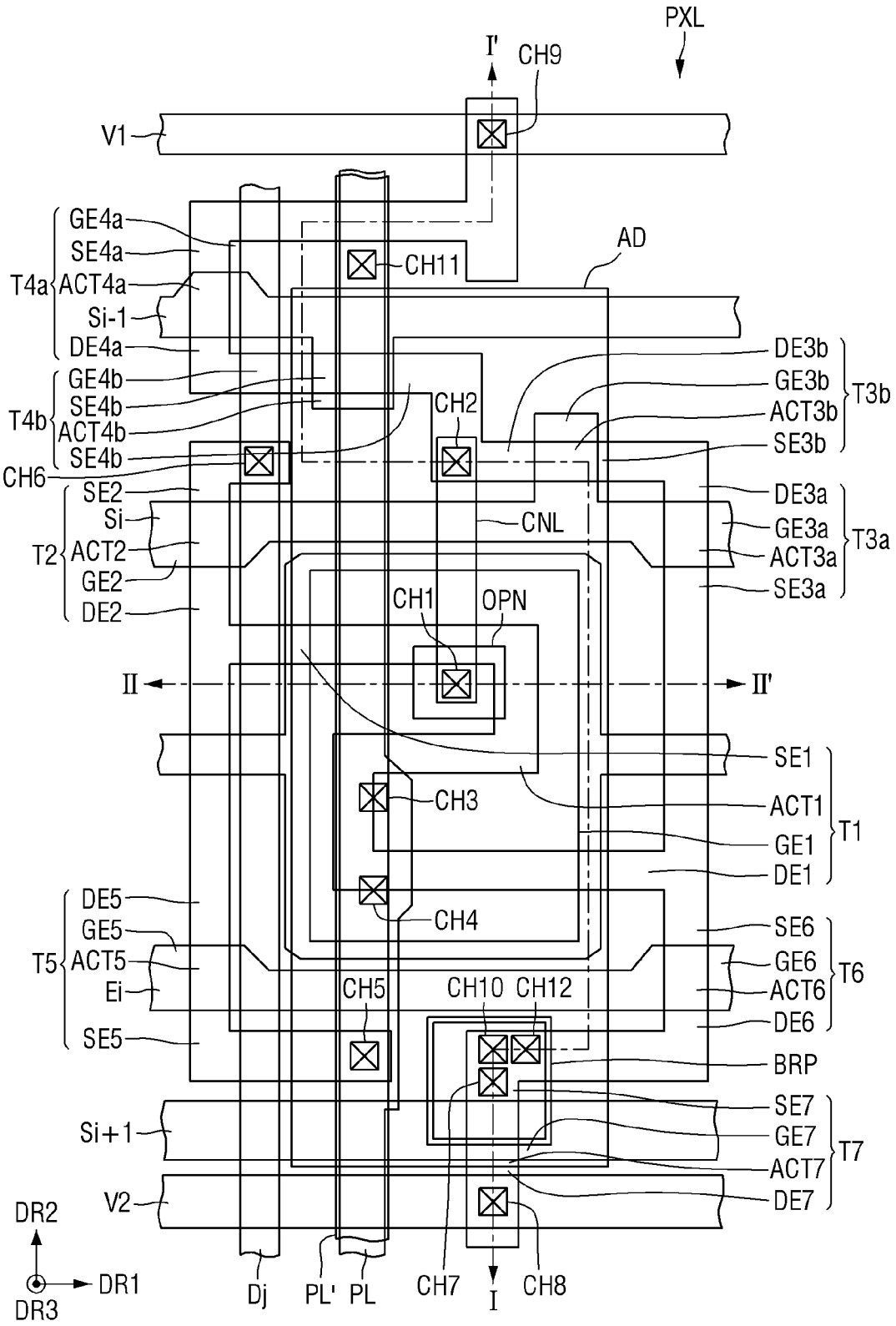
FIG. 6 is an enlarged plan view showing the pixel of FIG. 3.
Figure 7:
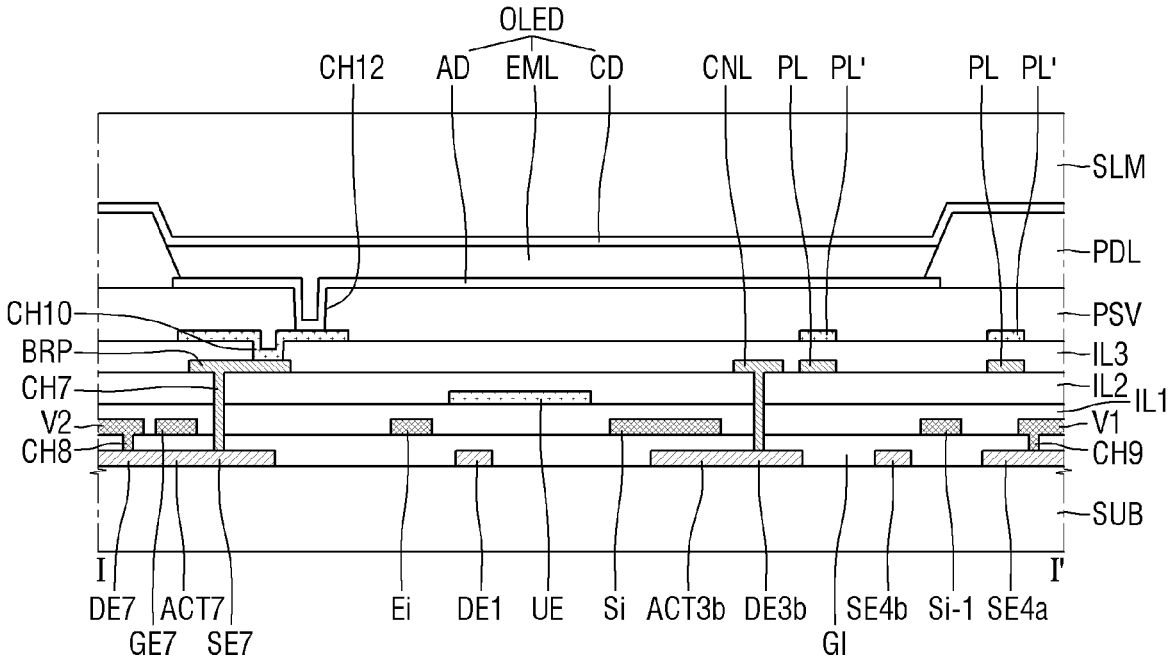
FIG. 7 is a cross-sectional view taken along line I-I' of FIG. 6.
Figure 8:
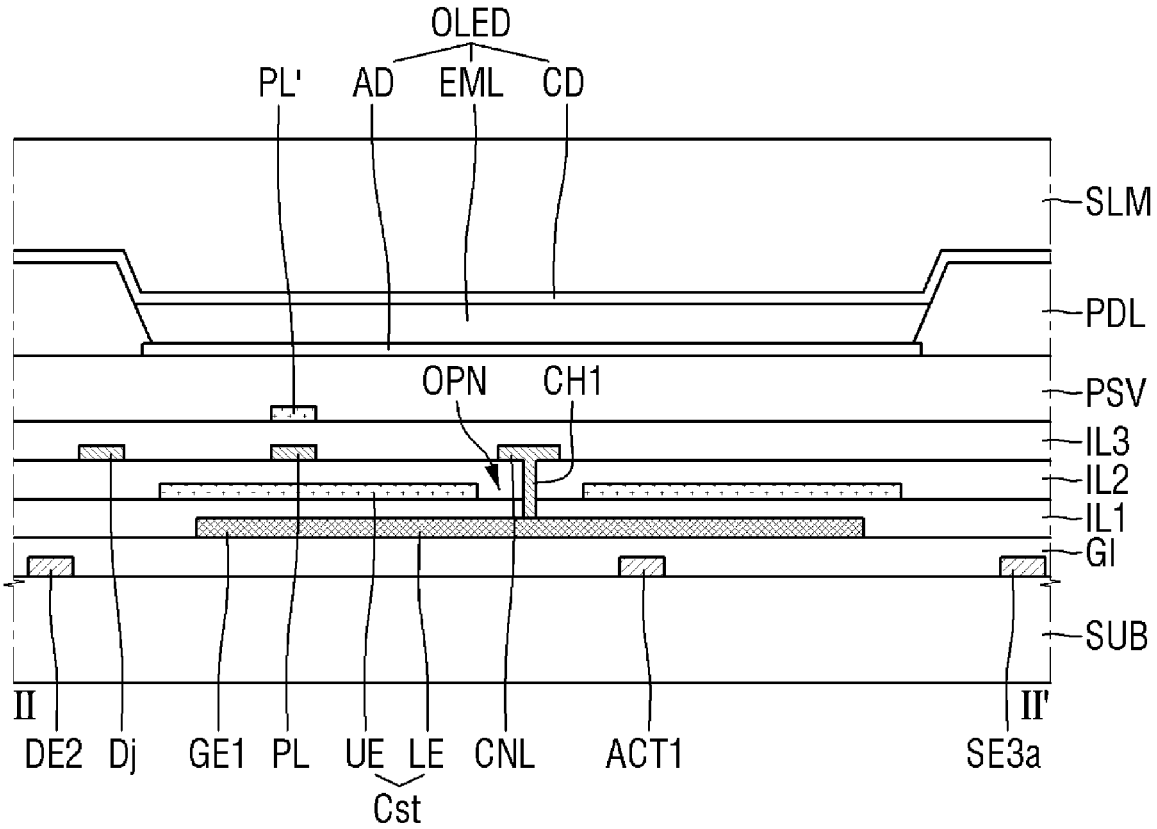
FIG. 8 is a cross-sectional view taken along line II-II' of FIG. 6.

FIG. 6 is an enlarged plan view showing the pixel PXL of FIG. 3 in detail. FIG. 7 is a cross-sectional view taken along line I-I' of FIG. 6. FIG. 8 is a cross-sectional view taken along line II-IP of FIG. 6.

FIGS. 6, 7 and 8 show three scan lines S(i−1), Si and S(i+1), an emission control line Ei, a power line PL, an additional power line PL' and a data line Dj connected to a pixel PXL disposed in the $i^{th}$ row and the $i^{th}$ column in the pixel area PXA. In FIG. 7 and FIG. 8, for convenience of illustration, the scan line in the $(i-1)^{th}$ row is denoted by the $(i-1)^{th}$ scan line S(i−1), the scan line in the $i^{th}$ row is denoted by the $i^{th}$ scan line Si, the scan line in the $(i+1)^{th}$ row is denoted by the $(i+1)^{th}$ scan line (Si+1), the emission control line in the $i^{th}$ row is denoted by the emission control line Ei, the data line in the $i^{th}$ column is denoted by the data line Dj, the $i^{th}$ power line is denoted by the power line PL, and the additional power line is denoted by the additional power line PL'.

Referring to FIGS. 3 to 6, 7 and 8, the display device 1 includes a substrate SUB, lines, and pixels PXL.

The lines provide signals to each of the pixels PXL and include the scan lines S(i−1), Si and S(i+1), the data line Dj, the emission control line Ei, the power line PL, the additional power line PL', and the first and second initialization voltage lines V1 and V2.

The scan lines S(i−1), Si and S(i+1) are extended along the first direction DR1 and include the (i−1) scan line S(i−1), the $i^{th}$ scan line Si and the $(i+1)^{th}$ scan line S(i+1) arranged along the second direction DR2 in this order. Scan signals are applied to the scan lines S(i−1), Si and S(i+1). The $(i-1)^{th}$ scan signal is applied to the $(i-1)^{th}$ scan line S(i−1), the $i^{th}$ scan signal is applied to the $i^{th}$ scan line Si, and the $(i+1)^{th}$ scan signal is applied to the $(i+1)^{th}$ scan signal S(i+1).

The emission control line Ei is extended along the first direction DR1 and is disposed between the $i^{th}$ scan line Si and the $(i+1)^{th}$ scan line S(i+1) such that it is spaced apart from the $i^{th}$ scan line Si and the $(i+1)^{th}$ scan line S(i+1). An emission control signal is applied to the emission control line Ei.

The data line Dj is extended along the second direction DR2. A data signal is applied to the data line Dj.

The power line PL is extended along the second direction DR2 and is spaced apart from the data line Dj. The first supply voltage ELVDD is applied to the power line PL.

The additional power line PL' overlaps the power line PL along a thickness direction (e.g., third direction DR3), and is connected to the power line PL to apply the same one of the first supply voltage ELVDD through an eleventh contact hole CH11.

The first initialization voltage line V1 is extended along the first direction DR1 and is disposed between the (i+1) scan line S(i+1) and the (i−1) scan line S(i−1) of the next pixel row. The first initialization voltage Vint1 is applied to the first initialization voltage line V1.

The second initialization voltage line V2 is extended along the first direction DR1 and is disposed between the (i+1) scan line S(i+1) and the (i−1) scan line S(i−1) of the next row pixel. The second initialization voltage Vint2 is applied to the second initialization voltage line V2.

Each pixel PXL includes a first transistor T1 to a seventh transistor T7, a storage capacitor Cst, and an organic light-emitting diode OLED.

The first transistor T1 includes a first gate electrode GE1, a first active pattern ACT1, a first source electrode SE1, a first drain electrode DE1, and a connection line CNL.

The first gate electrode GE1 is connected to a third drain electrode DE3 of the third transistor T3 and the fourth drain electrode DE4 of the fourth transistor T4. A connection line CNL connects the first gate electrode GE1 the third drain electrode DE3 to each other and the first gate electrode GE1 and the fourth drain electrode DE4 to each other. One end of the connection line CNL is connected to the first gate electrode GE1 through a first contact hole CH1, and the other end of the connection line CNL is connected to the third drain electrode DE3 and the fourth drain electrode DE4 through a second contact hole CH2.

According to an exemplary embodiment of the present disclosure, the first active pattern ACT1, the first source electrode SE1 and the first drain electrode DE1 may be provided or formed as a semiconductor layer doped with impurities or a semiconductor layer not doped with impurities. The first source electrode SE1 and the first drain electrode DE1 may be provided or formed of a semiconductor layer doped with impurities, while the first active pattern ACT1 may be provided or formed of a semiconductor layer not doped with impurities.

The first active pattern ACT1 may have a rod shape extended in a predetermined direction and may have a shape that is bent several times in the extended length direction. The first active pattern ACT1 overlaps the first gate electrode GE1 when viewed from the top (e.g., a plan view). Since the first active pattern ACT1 is provided or formed to be relatively long, the channel region of the first transistor T1 is provided or formed to be relatively long. Accordingly, the driving range of the gate voltage applied to the first transistor T1 is widened. Accordingly, the grayscale of light emitted from the organic light-emitting diode OLED can be adjusted precisely in later use.

The first source electrode SE1 is connected to one end of the first active pattern ACT1, and is connected to the second drain electrode DE2 of the second transistor T2 and the fifth drain electrode DE5 of the fifth transistor T5. The first drain electrode DE1 is connected to the other end of the first active pattern ACT1, and is connected to the third source electrode SE3 of the third transistor T3 and the sixth source electrode SE6 of the sixth transistor T6.

The second transistor T2 includes a second gate electrode GE2, a second active pattern ACT2, a second source electrode SE2, and a second drain electrode DE2.

The second gate electrode GE2 is connected to the $i^{th}$ scan line Si. The second gate electrode GE2 is provided or formed as a part of the $i^{th}$ scan line Si or may protrude from the $i^{th}$ scan line Si. According to an exemplary embodiment of the present disclosure, the second active pattern ACT2, the second source electrode SE2 and the second drain electrode DE2 may be provided or formed as a semiconductor layer doped with impurities or a semiconductor layer not doped with impurities. The second source electrode SE2 and the second drain electrode DE2 may be provided or formed of a semiconductor layer doped with impurities, while the second active pattern ACT2 may be provided or formed of a semiconductor layer not doped with impurities. The second active pattern ACT2 corresponds to the portion overlapping with the second gate electrode GE2. One end of the second source electrode SE2 is connected to the second active pattern ACT2, and the other end thereof is connected to the data line Dj through a sixth contact hole CH6. One end of the second drain electrode DE2 is connected to the second active pattern ACT2, and the other end of the second drain electrode DE2 is connected to the first source electrode SE1 of the first transistor T1 and the fifth drain electrode of the fifth transistor T5.

The third transistor T3 may be implemented as a double-gate structure to reduce or effectively prevent leakage current. That is to say, the third transistor T3 may include a transistor T3*a* and a transistor T3*b*. The transistor T3*a* may include a gate electrode GE3*a*, an active pattern ACT3*a*, a source electrode SE3*a* and a drain electrode DE3*a*. The transistor T3*b* may include a gate electrode GE3*b*, an active pattern ACT3*b*, a source electrode SE3*b* and a drain electrode DE3*b*. In the following description, the gate electrode GE3*a* and the gate electrode GE3*b* are referred to as the third gate electrode GE3, the active pattern ACT3*a* and the active pattern ACT3*b* are referred to as the third active pattern ACT3, the source electrode SE3*a* and the source electrode SE3*b* are referred to as the third source electrode SE3, and the drain electrode DE3*a* and the drain electrode DE3*b* are referred to as the third drain electrode DE3.

The third gate electrode GE3 is connected to the $i^{th}$ scan line Si. The third gate electrode GE3 is provided or formed as a part of the $i^{th}$ scan line Si or may protrude from the $i^{th}$ scan line Si. According to an exemplary embodiment of the present disclosure, the third active pattern ACT3, the third source electrode SE3 and the third drain electrode DE3 may be provided or formed as a semiconductor layer doped with impurities or a semiconductor layer not doped with impurities. The third source electrode SE3 and the third drain electrode DE3 may be provided or formed of a semiconductor layer doped with impurities, while the third active pattern ACT3 may be provided or formed of a semiconductor layer not doped with impurities. The third active pattern ACT3 corresponds to the portion overlapping with the third gate electrode GE3. One end of the third source electrode SE3 is connected to the third active pattern ACT3, and the other end of the third source electrode SE3 is connected to the first drain electrode DE1 of the first transistor T1 and the sixth source electrode SE6 of the sixth transistor T6. One end of the third drain electrode DE3 is connected to the third active pattern ACT3, and the other end thereof is connected to the fourth drain electrode DE4 of the fourth transistor T4. In addition, the third drain electrode DE3 is connected to the first gate electrode GE1 of the first transistor T1 through the connection line CNL, the second contact hole CH2 and the first contact hole CH1.

The fourth transistor T4 may be implemented as a double-gate structure to reduce or effectively prevent leakage current. That is to say, the fourth transistor T4 may include a transistor T4*a* and a transistor T4*b*. The transistor T4*a* may include a gate electrode GE4*a*, an active pattern ACT4*a*, a source electrode SE4*a* and a drain electrode DE4*a*. The transistor T4*b* may include a gate electrode GE4*b*, an active pattern ACT4*b*, a source electrode SE4*b* and a drain electrode DE4*b*. In the following description, the gate electrode GE4*a* and the gate electrode GE4*b* are referred to as the fourth gate electrode GE4, the active pattern ACT4*a* and the active pattern ACT4*b* are referred to as the fourth active pattern ACT4, the source electrode SE4*a* and the source electrode SE4*b* are referred to as the fourth source electrode SE4, and the drain electrode DE4*a* and the drain electrode DE4*b* are referred to as the fourth drain electrode DE4.

The fourth gate electrode GE4 is connected to the $(i-1)^{th}$ scan line S(i−1). The fourth gate electrode GE4 is provided or formed as a part of the $(i-1)^{th}$ scan line S(i−1) or may protrude from the $(i-1)^{th}$ scan line S(i−1). The fourth active pattern ACT4, the fourth source electrode SE4 and the fourth drain electrode DE4 are provided or formed of a semiconductor layer doped with impurities or a semiconductor layer not doped with impurities. The fourth source electrode SE4 and the fourth drain electrode DE4 are provided or formed of a semiconductor layer doped with impurities, and the fourth active pattern ACT4 is provided or formed of a semiconductor layer not doped with impurities. The fourth active pattern ACT4 corresponds to the portion overlapping with the fourth gate electrode GE4. One end of the fourth source electrode SE4 is connected to the fourth active pattern ACT4, and the other end thereof is connected to the first initialization voltage line V1. The source electrode SE4*a* is connected to the first initialization voltage line V1 through a ninth contact hole CH9. One end of the fourth drain electrode DE4 is connected to the fourth active pattern ACT4, and the other end thereof is connected to the third drain electrode DE3 of the third transistor T3. In addition, the fourth drain electrode DE4 is connected to the first gate electrode GE1 of the first transistor T1 through the connection line CNL, the second contact hole CH2 and the first contact hole CH1.

The fifth transistor T5 includes a fifth gate electrode GE5, a fifth active pattern ACT5, a fifth source electrode SE5, and a fifth drain electrode DE5.

The fifth gate electrode GE5 is connected to the emission control line Ei. The fifth gate electrode GE5 is provided or formed as a part of the emission control line Ei or may protrude from the emission control line Ei. The fifth active pattern ACT5, the fifth source electrode SE5 and the fifth drain electrode DE5 are provided or formed of a semiconductor layer doped with impurities or a semiconductor layer not doped with impurities. The fifth source electrode SE5 and the fifth drain electrode DE5 are provided or formed of a semiconductor layer doped with impurities, and the fifth active pattern ACT5 is provided or formed of a semiconductor layer not doped with impurities. The fifth active pattern ACT5 corresponds to the portion overlapping with the fifth gate electrode GE5. One end of the fifth source electrode SE5 is connected to the fifth active pattern ACT5, and the other end thereof is connected to the power line PL through the fifth contact hole CH5. One end of the fifth drain electrode DE5 is connected to the fifth active pattern ACT5, and the other end of the fifth drain electrode DE5 is connected to the first source electrode SE1 of the first transistor T1 and the second drain electrode DE2 of the second transistor T2.

The sixth transistor T6 includes a sixth gate electrode GE6, a sixth active pattern ACT6, a sixth source electrode SE6, and a sixth drain electrode DE6.

The sixth gate electrode GE6 is connected to the emission control line Ei. The sixth gate electrode GE6 is provided or formed as a part of the emission control line Ei or may protrude from the emission control line Ei. The sixth active pattern ACT6, the sixth source electrode SE6 and the sixth drain electrode DE6 are provided or formed of a semiconductor layer doped with impurities or a semiconductor layer not doped with impurities. The sixth source electrode SE6 and the sixth drain electrode DE6 are provided or formed of a semiconductor layer doped with impurities, and the sixth active pattern ACT6 is provided or formed of a semiconductor layer not doped with impurities. The sixth active pattern ACT6 corresponds to the portion overlapping with the sixth gate electrode GE6. One end of the sixth source electrode SE6 is connected to the sixth active pattern ACT6, and the other end thereof is connected to the first drain electrode DE1 of the first transistor T1 and the third source electrode SE3 of the third transistor T3. One end of the sixth drain electrode DE6 is connected to the sixth active pattern ACT6, and the other end thereof is connected to the seventh source electrode SE7 of the seventh transistor T7.

The seventh transistor T7 includes a seventh gate electrode GE7, a seventh active pattern ACT7, a seventh source electrode SE7, and a seventh drain electrode DE7.

The seventh gate electrode GE7 is connected to the $(i+1)^{th}$ scan line S(i+1). The seventh gate electrode GE7 is provided or formed as a part of the $(i+1)^{th}$ scan line S(i+1) or may protrude from the $(i+1)^{th}$ scan line S(i+1). The seventh active pattern ACT7, the seventh source electrode SE7 and the seventh drain electrode DE7 are provided or formed of a semiconductor layer doped with impurities or a semiconductor layer not doped with impurities. The seventh source electrode SE7 and the seventh drain electrode DE7 are provided or formed of a semiconductor layer doped with impurities, and the seventh active pattern ACT7 is provided or formed of a semiconductor layer not doped with impurities. The seventh active pattern ACT7 corresponds to the portion overlapping with the seventh gate electrode GE7. One end of the seventh source electrode SE7 is connected to the seventh active pattern ACT7, and the other end thereof is connected to the sixth drain electrode DE6 of the sixth transistor T6. One end of the seventh drain electrode DE7 is connected to the seventh active pattern ACT7, and the other end thereof is connected to the second initialization voltage line V2. The seventh drain electrode DE7 is connected to the second initialization voltage line V2 through an eighth contact hole CH8.

The storage capacitor Cst includes a lower electrode LE and an upper electrode UE. The lower electrode LE may be provided or formed as the first gate electrode GE1 of the first transistor T1.

The upper electrode UE overlaps the first gate electrode GE1 and covers the lower electrode LE when viewed from the top. The capacitance of the storage capacitor Cst may be increased by increasing the planar area where the upper electrode UE and the lower electrode LE overlap each other. The upper electrode UE may be extended along the first direction DR1. According to an exemplary embodiment of the present disclosure, a voltage having the same level as that of the first supply voltage ELVDD may be applied to the upper electrode UE. The upper electrode UE has an opening OPN where the first contact hole CH1 is provided or formed, at which the first gate electrode GE1 is in contact with the connection line CNL.

The organic light-emitting diode OLED includes an anode AD, a cathode CD, and an emission layer EML interposed between the anode AD and the cathode CD.

The anode AD is disposed in the pixel region corresponding to each pixel PXL. The anode AD is connected to a seventh source electrode SE7 of the seventh transistor T7 and a sixth drain electrode DE6 of the sixth transistor T6 through a seventh contact hole CH7 and a tenth contact hole CH10. A bridge pattern BRP is disposed between the seventh contact hole CH7 and the tenth contact hole CH10 to connect the sixth drain electrode DE6 and the seventh source electrode SE7 with the anode AD.

Referring back to FIGS. 6, 7 and 8, the structure of the display device according to the exemplary embodiment of the present disclosure will be described in the stacking order along the thickness direction.

Initially, active patterns ACT1 to ACT7 (hereinafter, ACT) are disposed on the substrate SUB. The active pattern includes a first active pattern ACT1 to a seventh active pattern ACT7. The first active pattern ACT1 to seventh active pattern ACT7 include or are made of a semiconductor material.

A buffer layer may be disposed between the substrate SUB and the first active pattern ACT1 to seventh active pattern ACT7.

A gate insulating layer GI is disposed on the substrate SUB on which the first active pattern ACT1 and the seventh active pattern ACT7 are provided or formed.

On the gate insulating layer GI, the $(i-1)^{th}$ scan line S(i−1) to the $(i+1)^{th}$ scan line S(i+1), the emission control line Ei, the first initialization voltage line V1, the second initialization voltage line V2, the first gate electrode GE1, and the seventh gate electrode GE7 are disposed. The first gate electrode GE1 serves as the lower electrode LE of the storage capacitor Cst. The second gate electrode GE2 and the third gate electrode GE3 may be provided or formed integrally with the $i^{th}$ scan line Si, the fourth gate electrode GE4 may be provided or formed integrally with the $(i-1)^{th}$ scan line S(i−1), the fifth gate electrode GE5 and the sixth gate electrode GE6 may be provided or formed integrally with the emission control line Ei, and the seventh gate electrode GE7 may be provided or formed integrally with the (i+1) scan line S(i+1).

A first insulating layer IL1 is disposed on the substrate SUB on which the $(i-1)^{th}$ scan line S(i−1) and the like are provided or formed.

The upper electrode UE of the storage capacitor Cst and the initialization power line IPL are disposed on the first insulating layer IL'. The upper electrode UE covers the lower electrode LE and forms the storage capacitor Cst together with the lower electrode LE, with the first insulating layer IL1 interposed therebetween.

The second insulating layer IL2 is disposed on the substrate SUB on which the upper electrode UE and the like are provided or formed.

The $i^{th}$ data line Dj, the power line PL, the connection line CNL and the bridge pattern BRP are disposed on the second insulating layer IL2.

The $i^{th}$ data line Dj is connected to the second source electrode SE2 through the sixth contact hole CH6 penetrating through the first insulating layer ILL the second insulating layer IL2 and the gate insulating layer GI. The power line PL is connected to the upper electrode UE of the storage capacitor Cst through third and fourth contact holes CH3 and CH4 penetrating the second insulating layer IL2.

The power line PL is connected to the fifth source electrode SE5 through the fifth contact hole CH5 penetrating through the first insulating layer ILL the second insulating layer IL2 and the gate insulating layer GI.

The connection line CNL is connected to the first gate electrode GE1 through the first contact hole CH1 penetrating the first insulating layer IL1 and the second insulating layer IL2. The connection line CNL may be connected also to the third drain electrode DE3 and the fourth drain electrode DE4 through the second contact hole CH2 penetrating the gate insulating layer GI, the first insulating layer IL1 and the second insulating layer IL2.

The bridge pattern BRP is a pattern provided as an intermediate member connecting the sixth drain electrode DE6 with the anode AD between the sixth drain electrode DE6 and the anode AD, and is connected to the sixth drain electrode DE6 and the seventh source electrode SE7 through the contact hole CH7 penetrating the gate insulating layer GI, the first insulating layer IL1 and the second insulating layer IL2.

A third insulating layer IL3 is disposed on the substrate SUB on which the $j^{th}$ data line Dj and the like are provided or formed.

The additional power line PL' is disposed on the third insulating layer IL3. The additional power line PL' is for stably supplying the first supply voltage ELVDD to the power line PL without delay and reduces the electrical resistance applied to the power line PL. The additional power line PL' is extended along the second direction DR2 and overlaps the power line PL'. The additional power line PL' is connected to the power line PL through the eleventh contact hole CH11 penetrating the third insulating layer IL3.

A passivation layer PSV is disposed on the third insulating layer IL3 provided with the additional power line PL'.

The anode AD is disposed on the passivation layer PSV. The anode AD is connected to the bridge pattern BRP through the twelfth contact hole CH12 penetrating the passivation layer PSV. Since the bridge pattern BRP is connected to the sixth drain electrode DE6 and the seventh source electrode SE7 through the seventh contact hole CH7, the anode AD is finally connected to the sixth drain electrode DE6 and the seventh source electrode SE7.

On the substrate SUB on which the anode AD and the like are provided or formed, a pixel-defining layer PDL is disposed to partition a pixel region within each pixel PXL. Within the pixel PXL, the pixel-defining layer PDL defines an open area at which light is emitted (e.g., light emission region or pixel region). The pixel-defining layer PDL exposes the upper surface of the anode AD and protrudes from the substrate SUB along the boundary of the pixel PXL.

The emission layer EML is disposed in the pixel region surrounded by the pixel-defining layer PDL in the pixel PXL, and the cathode CD is disposed on the emission layer EML.

A sealing member SLM covering the cathode CD is disposed on the cathode CD.

Figure 9:
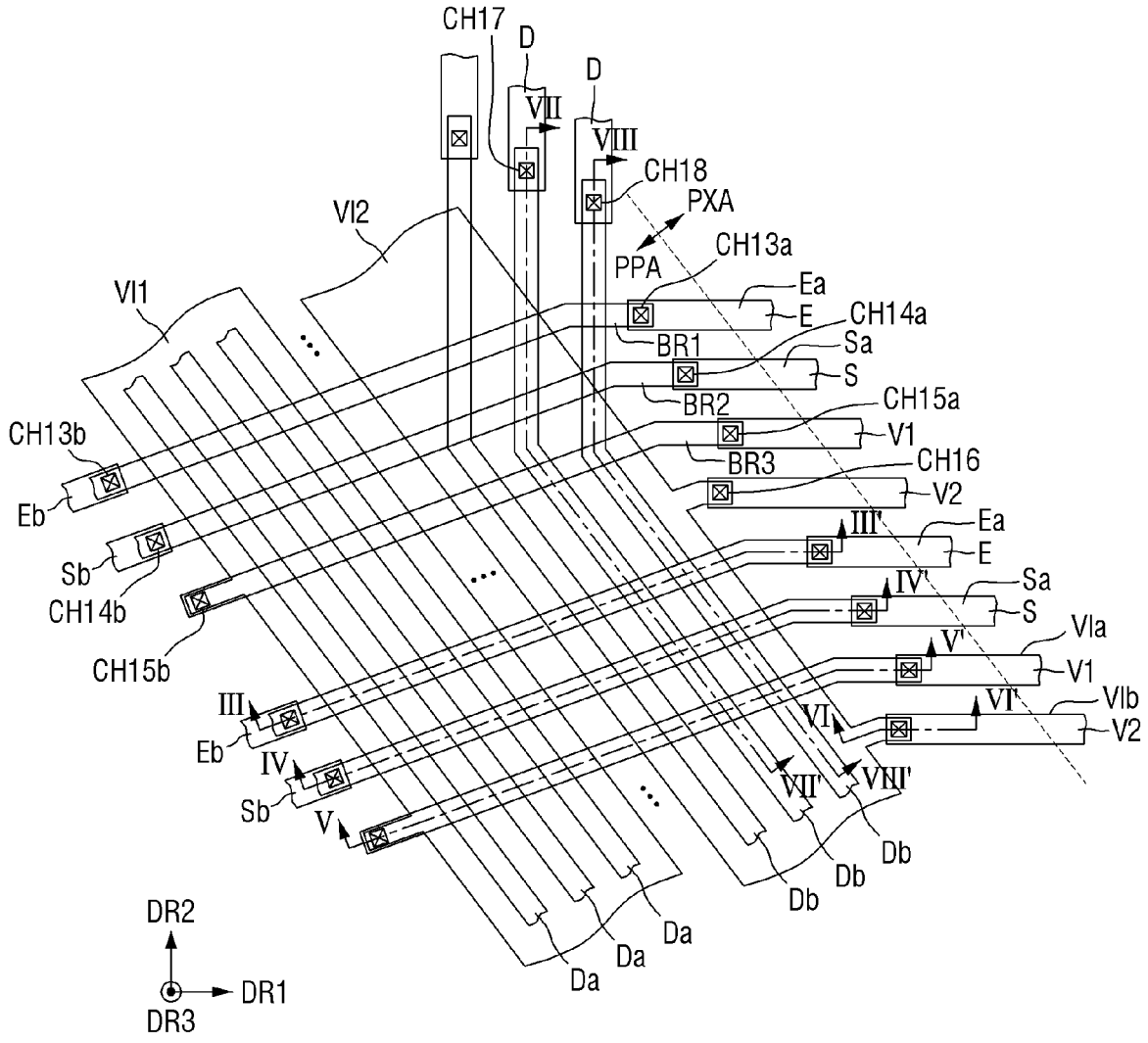
FIG. 9 is an enlarged plan view showing an exemplary embodiment of portion P2 of FIG. 3.
Figure 10:
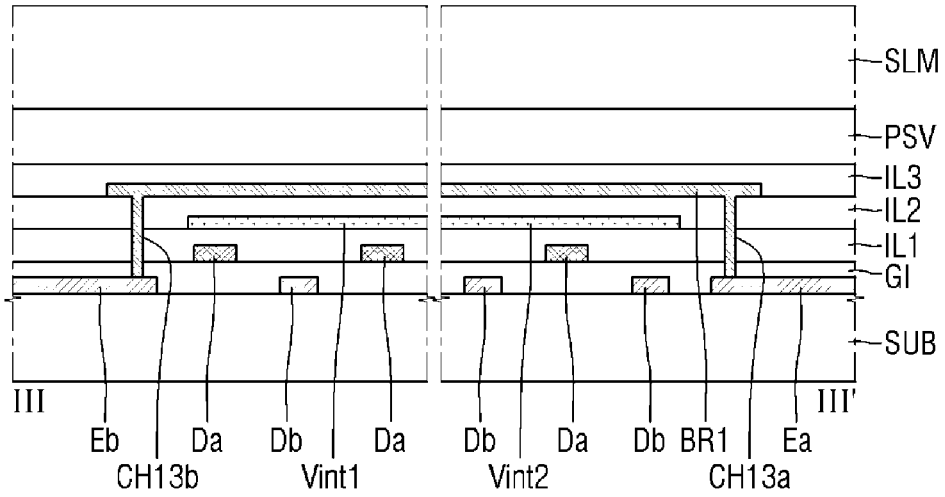
FIG. 10 is a cross-sectional view taken along line III-III' of FIG. 9.
Figure 11:
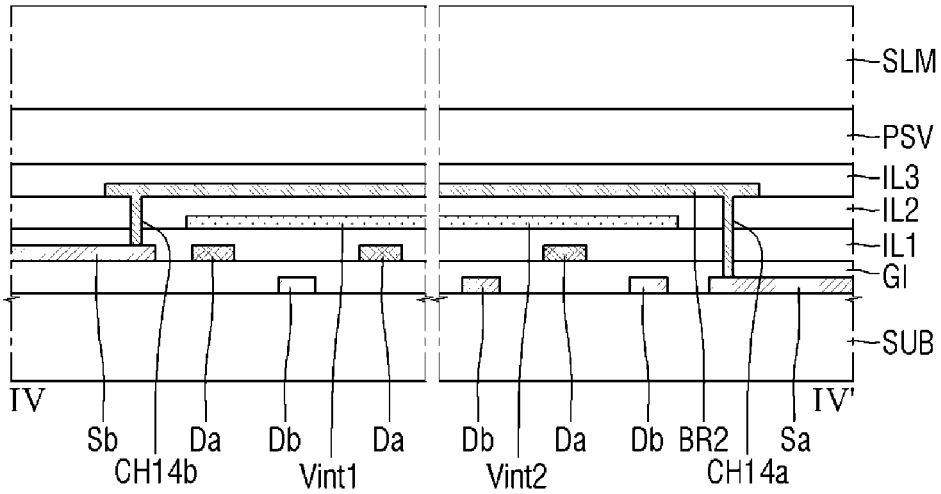
FIG. 11 is a cross-sectional view taken along line IV-IV' of FIG. 9.
Figure 12:
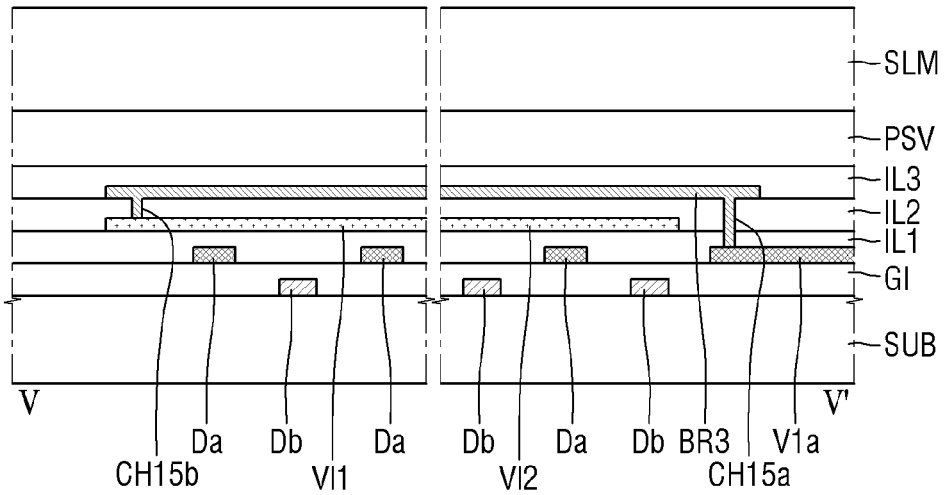
FIG. 12 is a cross-sectional view taken along line V-V' of FIG. 9.
Figure 13:
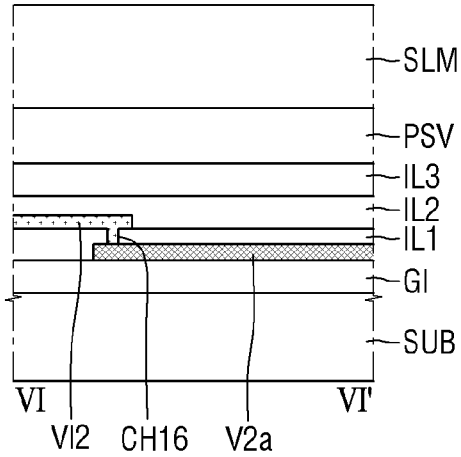
FIG. 13 is a cross-sectional view taken along line VI-VI' of FIG. 9.
Figure 14:
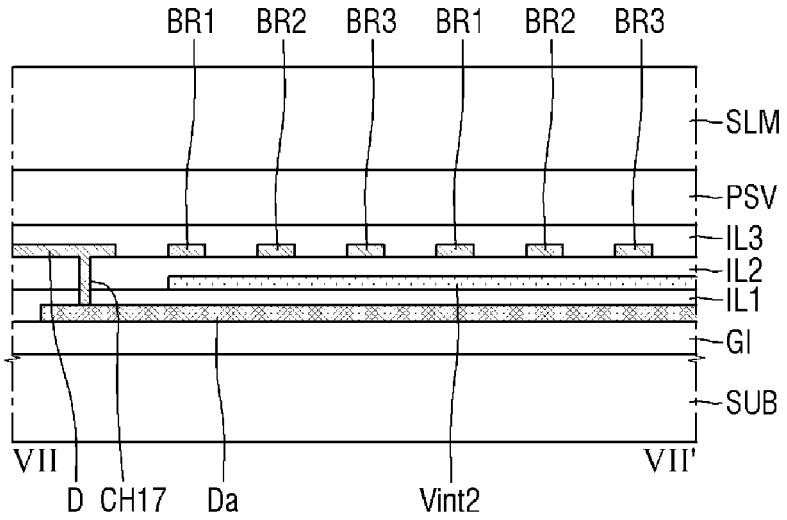
FIG. 14 is a cross-sectional view taken along line IV-IV' of FIG. 9.
Figure 15:
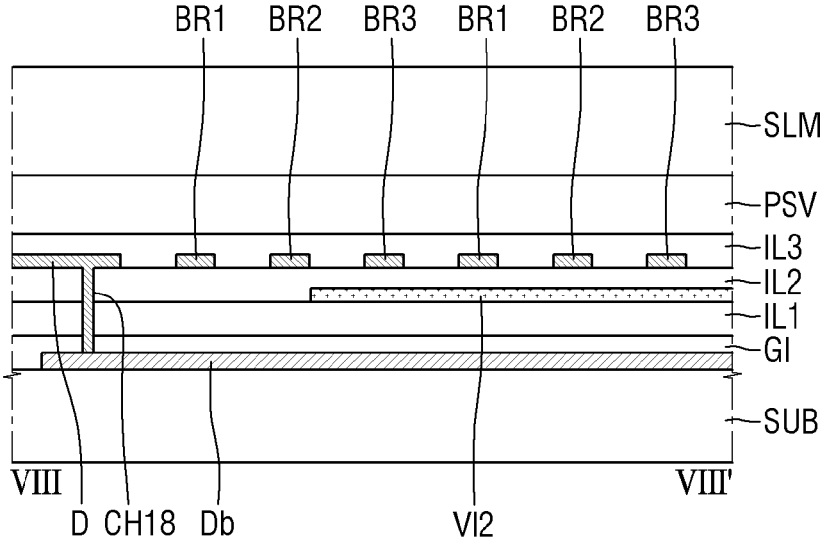
FIG. 15 is a cross-sectional view taken along line V-V' of FIG. 9.

FIG. 9 is an enlarged plan view showing an exemplary embodiment of portion P2 of FIG. 3. FIG. 10 is a cross-sectional view taken along line III-III' of FIG. 9. FIG. 11 is a cross-sectional view taken along line IV-IV' of FIG. 9. FIG. 12 is a cross-sectional view taken along line V-V' of FIG. 9. FIG. 13 is a cross-sectional view taken along line VI-VI' of FIG. 9. FIG. 14 is a cross-sectional view taken along line IV-IV' of FIG. 9. FIG. 15 is a cross-sectional view taken along line V-V' of FIG. 9.

In FIGS. 9 to 15, for convenience of illustration of the relationship between the lines, one of the scan lines connected to a single pixel PXL and a single emission control line are illustrated as an example, which are denoted by the scan line S and the emission control line E, respectively. In addition, only a portion of the first and second initialization voltage lines are depicted. The first initialization voltage source is referred to as the first initialization voltage source Vint1, the first initialization voltage line is referred to as the first initialization voltage line V1, the second initialization voltage source is referred to as the second initialization voltage source VI2, and the second initialization voltage line is referred to as the second initialization voltage line V2. In addition, only a portion of the data lines are shown, and the data lines are shown as "data lines D." Although only a portion of the lines are depicted, scan lines, emission control lines, data lines, first initialization voltage lines and second initialization voltage lines, which are not shown, may be further provided in the manner described below.

Hereinafter, connective relationships between the lines will be described with reference to FIGS. 9 to 15.

The emission control lines E are extended along the first direction DR1 from the pixel area PXA, and are also extended into the peripheral area PPA generally along the first direction DR1. When viewed from the top, the emission control lines E are spaced apart from the scan lines S by a predetermined distance and at least a portion thereof are extended in parallel with the scan lines S. The emission control lines E may be bent in a direction inclined with respect to the first direction DR1 depending on the positions at the corner, and may be extended in a direction inclined with respect to the first direction DR1. FIG. 9 shows the emission control lines E are bent in a direction inclined with respect to the first direction DR1 as an example.

The emission control lines E are disposed on the substrate SUB in the pixel area PXA. A buffer layer may be disposed between the emission control lines E and the substrate SUB.

Each of the emission control lines E includes in the peripheral area PPA a first portion Ea disposed on the substrate SUB and extended into the pixel area PXA, a first bridge BR1 disposed on the second insulating layer IL2, and a second portion Eb disposed on the substrate SUB.

The first bridge BR1 is for connecting the first portion Ea of the emission control line E with the second portion Eb of the emission control line E. The first bridge BR1 is connected to the first portion Ea of the emission control line E through a contact hole CH13*a* penetrating the gate insulating layer GI and the first and second insulating layers IL1 and IL2 and is connected to the second portion Eb of the emission control line E through a contact hole CH13*b* penetrating through the gate insulating layer GI and the first and second insulating layers IL1 and IL2.

The scan lines S are extended along the first direction DR1 from the pixel area PXA, and are also extended in the peripheral area PPA generally along the first direction DR1. However, the scan lines S may be bent in a direction inclined with respect to the first direction DR1 depending on the location of the corner and then extended. FIG. 9 shows that the scan lines S are bent in a direction inclined with respect to the first direction DR1.

The scan lines S are disposed on the substrate SUB in the pixel area PXA. A buffer layer may be disposed between the scan lines S and the substrate SUB. The scan lines S may be connected in substantially the same manner as the emission control line E. Specifically, each of the scan lines S includes in the peripheral area PPA a first portion Sa disposed on the substrate SUB, a second bridge BR2 disposed on the second insulating layer IL2, and a second portion Sb disposed on the gate insulating layer GI.

The second bridge BR2 is for connecting the first portion Sa of the scan line S with the second portion Sb of the scan line S. The second bridge BR2 is connected to the first portion Sa of the scan line S through a contact hole CH14*a* penetrating the gate insulating layer GI and the first and second insulating layers IL1 and IL2 and is connected to the second portion Sb of the scan line S through a contact hole CH14*b* penetrating through the first and second insulating layers IL1 and IL2.

The first initialization voltage line V1 is extended along the first direction DR1 from the pixel area PXA, and is also extended in the peripheral area PPA generally along the first direction DR1. When viewed from the top, the first initialization voltage line V1 is spaced apart from the scan lines S by a predetermined distance and at least a part thereof is extended in parallel with the scan lines S. The first initialization voltage line V1 may be bent in a direction inclined with respect to the first direction DR1 depending on the positions at the corner, and may be extended in a direction inclined with respect to the first direction DR1. FIG. 9 shows that the first initialization voltage lines V1 are bent in a direction inclined with respect to the first direction DR1 as an example.

The first initialization voltage line V1 is disposed on the gate insulating layer GI in the pixel area PXA. The first initialization voltage lines V1 may include in the peripheral area PPA a first portion V1*a* disposed on the gate insulating layer GI, a third bridge BR3 disposed on the second insulating layer IL2, and the first initialization voltage source Vint1 provided on the first insulating layer IL'. The first initialization voltage source Vint1 may include an output terminal protruding from the first initialization voltage source Vint1 in a direction inclined with respect to the first direction DR1.

The third bridge BR3 is for connecting the first portion V1*a* of the first initialization voltage line V1 with the output terminal of the first initialization voltage source Vint1. The third bridge BR3 is connected to the first portion V1*a* of the first initialization voltage line V1 through a contact hole CH15*a* penetrating the first and second insulating layers IL1 and IL2, and is connected to an output terminal of the first initialization voltage source Vint1 through a contact hole CH15*b* penetrating through the second insulating layer IL2.

The second initialization voltage line V2 is disposed on the gate insulating layer GI in the pixel area PXA. The second initialization voltage lines V2 may include in the peripheral area PPA a first portion V2*a* disposed on the gate insulating layer GI, and the second initialization voltage source VI2 provided on the first insulating layer IL'. The second initialization voltage source VI2 may include an output terminal protruding from the second initialization voltage source VI2 in a direction inclined with respect to the first direction DR1.

The second initialization voltage line V2 is connected to the second initialization voltage source VI2 through a sixteenth contact hole CH16 penetrating the first insulating layer IL'.

The data lines D are extended along the second direction DR2 from the pixel area PXA, and are also extended into the peripheral area PPA generally along the second direction DR2. However, the data lines D may be bent in a direction inclined with respect to the second direction DR2 depending on the location of the corner and then extended. FIG. 9 shows that the data lines D are bent in a direction inclined with respect to the second direction DR2 and then extended toward the right side.

The data lines D are disposed on the second insulating layer IL2 in the pixel area PXA. The data lines D include in the peripheral area PPA a first data line Da (e.g., data line portion Da) disposed on the gate insulating layer GI, and a second data line Db (e.g., data line portion Db) disposed on the substrate SUB. A buffer layer may be disposed between the second data line Db and the substrate SUB. Each of the first data line Da and the second data line Db may be provided in plural (e.g., first data lines Da and second data lines Db).

A portion of the data lines D extended from the pixel area PXA are connected to the first data lines Da through a seventeenth contact hole CH17 penetrating the first and second insulating layers IL1 and IL2. More than one contact hole may be provided or formed. Another portion of the data lines D extended from the pixel area PXA are connected to the second data lines Db through an eighteenth contact hole CH18 penetrating the gate insulating layer GI and the first and second insulating layers IL1 and IL2. More than one contact hole may be provided or formed.

The first data lines Da and the second data lines Db may be spaced apart from each other and may be arranged alternately when viewed from the top. At least a portion of the first data lines Da and the second data lines Db are extended in a direction parallel to each other.

Hereinafter, the structure of the lines in the peripheral area PPA will be described in the stacking order.

The gate insulating layer GI is disposed on the substrate SUB.

A buffer layer (not shown) may be disposed between the substrate SUB and the gate insulating layer GI.

On the substrate SUB, a first portion Sa of the scan lines S extended from the pixel area PXA, a first portion Ea of the emission control line E, a second portion Eb of the emission control line E and the second data lines Db are disposed. The first portion Sa of the scan lines S, the first portion Ea of the emission control line E, the second portion Eb of the emission control line E and the second data line Db may be provided from a same material via a same process as the scan lines S in the pixel area PXA. Accordingly, the first portion Sa of the scan lines S, the first portion Ea of the emission control line E, the second portion Eb of the emission control line E and the second data line Db may be in a same layer as the scan lines S in the pixel area PXA. As being "from a same material" or "in a same layer," elements may be respective portions of a same or common layer on the substrate SUB.

On the substrate SUB including the first portion Sa of the scan lines S, the first portion Ea of the emission control line E, the second portion Eb of the emission control line E and the second data lines Db, the gate insulating layer GI is disposed.

The first data lines Da, the second portion Sb of the scan lines S extended from the scan stage SST, the first initialization voltage line V1 and the second initialization voltage line V2 are disposed on the gate insulating layer GI.

The first insulating layer IL1 is disposed on the gate insulating layer GI covering the first data lines Da, the second portion Sb of the scan lines S extended from the scan stage SST, the first initialization voltage line V1 and the second initialization voltage line V2.

The first initialization voltage source Vint1 and the second initialization voltage source VI2 are disposed on the first insulating layer IL'. The first initialization voltage source Vint1 and the second initialization voltage source VI2 are not disposed in the same layer as the plurality of first data lines Da and the plurality of second data lines Db, but are disposed such that they overlap the plurality of first data lines Da and the second data lines Db along the third direction DR3, so that the dead space can be reduced near the corners of the pixel area PXA. Referring to FIG. 9, for example, along the rounded corner of the boundary between the pixel area PXA and the peripheral area PPA, the first initialization voltage source Vint1 and the second initialization voltage source VI2 each overlap a first data line Da and a second data line Db, along the thickness direction (e.g., third direction DR3). Along the rounded corner, a portion of lengths of the first initialization voltage source Vint1 and the second initialization voltage source VI2 correspond to and overlap lengths of the first data line Da and the second data line Db.

Specifically, if the first initialization voltage source Vint1 and the second initialization voltage source VI2, the plurality of first data lines Da and the plurality of second data lines Db are disposed in the same layer within the peripheral area PPA, the first and second data lines Da and Db, the first initialization voltage source Vint1 and the second initialization voltage source VI2, the scan driver SDV and the emission driver EDV are sequentially disposed from the corner of the pixel area PXA when viewed from the top and together occupy a relatively large planar area. As a result, the dead space in the display device 1 may be increased.

In contrast, in one or more exemplary embodiment, when the first initialization voltage source Vint1 and the second initialization voltage source VI2 overlap the plurality of first data lines Da and the plurality of second data lines Db to share a common planar area, the first initialization voltage source Vint1, the second initialization voltage source VI2, the scan driver SDV and the emission driver EDV are sequentially disposed from the corner of the pixel area PXA when viewed from the top to define a total planar area excluding planar areas of the first and second data lines Da and Db. As a result, the dead space in the display device 1 can be reduced.

A second insulating layer IL2 is disposed on the first insulating layer IL1 covering the first initialization voltage source Vint1 and the second initialization voltage source VI2.

The data line D extended from the pixel area PXA and the first to third bridges BR1, BR2, and BR3 are disposed on the second insulating layer IL2. The third insulating layer IL3 is disposed on the second insulating layer IL2 covering the data line D extended from the pixel area PXA and the first to third bridges BR1, BR2 and BR3.

A passivation layer PSV may be disposed on the third insulating layer IL3, and a sealing member SLM may be disposed on the passivation layer PSV. According to an exemplary embodiment of the present disclosure, a variety of layers may be further interposed between the third insulating layer IL3 and the passivation layer PSV and between the passivation layer PSV and the sealing member SLM. The sealing member SLM may be omitted.

Hereinafter, other exemplary embodiments of the present disclosure will be described. In the following description, the same or similar elements will be denoted by the same or similar reference numerals, and redundant descriptions will be omitted or briefly described. Descriptions will be made focusing on differences from the above exemplary embodiment.

Figure 16:
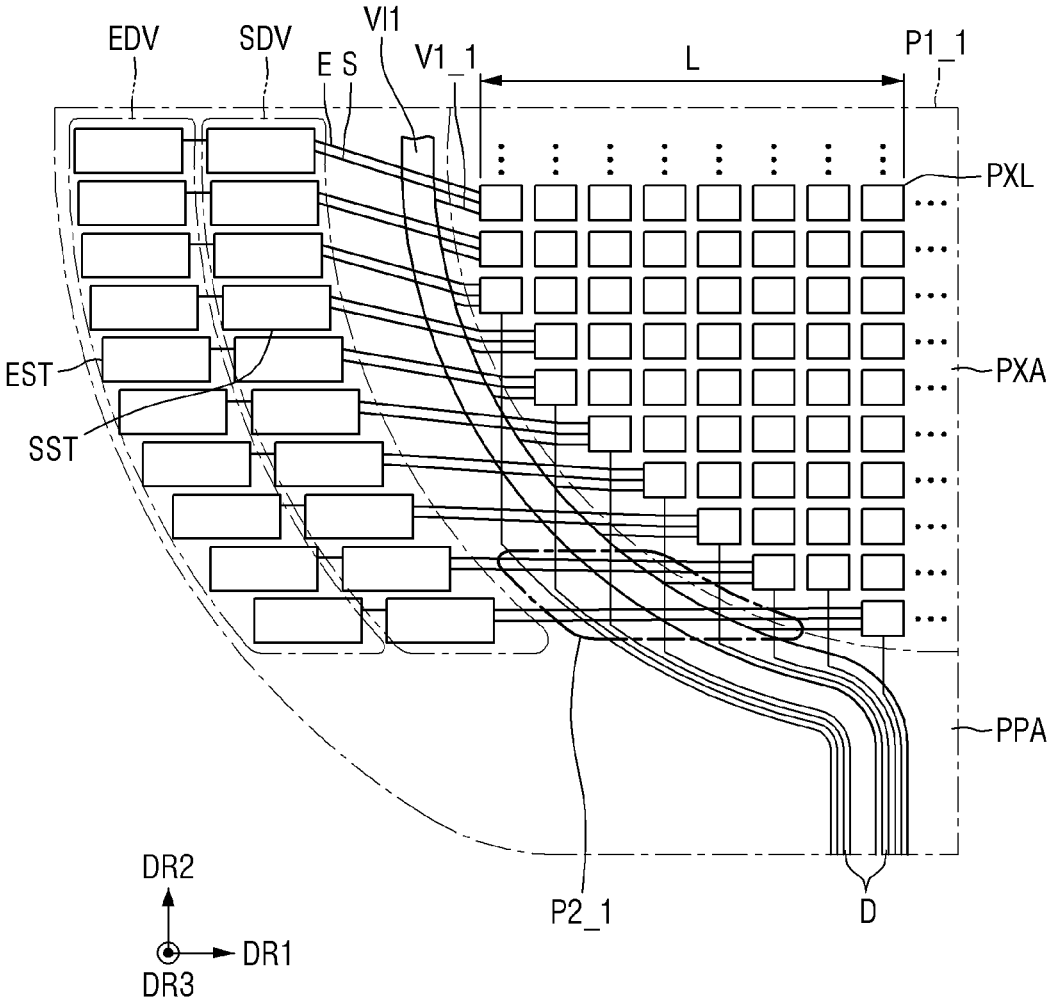
FIG. 16 is an enlarged plan view showing another exemplary embodiment of portion P1 of FIG. 1.
Figure 17:
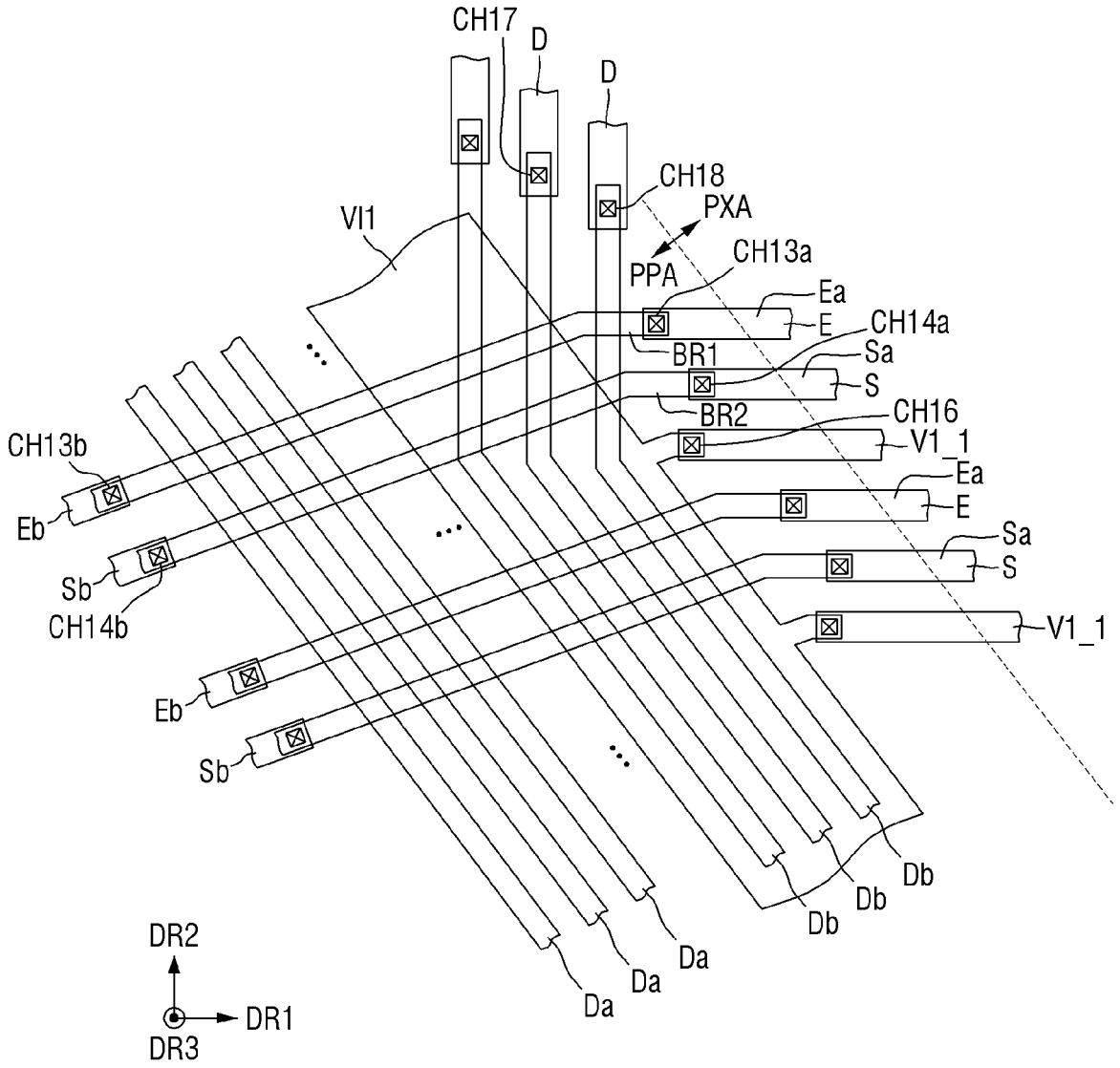
FIG. 17 is an enlarged plan view showing portion P2_1 of FIG. 16.

FIG. 16 is an enlarged plan view showing another exemplary embodiment of portion P1 of FIG. 1, labeled as portion P1_1 in FIG. 16, including a connective relationship between the pixels PXL, the lines and the drivers. FIG. 17 is an enlarged plan view showing portion P2_1 of FIG. 16.

The exemplary embodiment shown in FIGS. 16 and 17 is different from the exemplary embodiment shown in FIGS. 3 and 9 in that there is only one initialization voltage source, instead of two.

Specifically, according to the exemplary embodiment shown in FIGS. 16 and 17, the first portion V1*a* disposed on the gate insulating layer GI, the third bridge BR3 disposed on the second insulating layer IL2 and the first initialization voltage source Vint1 disposed on the insulating layer IL1 in the peripheral area PPA are eliminated.

Although not shown in the drawings, according to the exemplary embodiment shown in FIGS. 16 and 17, the fourth source electrode SE4 of the fourth transistor T4 and the seventh drain electrode DE7 of the seventh transistor T7 may be electrically connected and may be connected to the single initialization voltage source Vint1, unlike the exemplary embodiment shown in FIGS. 5 and 6 where in the pixel PXL, the fourth source electrode SE4 of the fourth transistor T4 is connected to the first initialization voltage source Vint1 and the seventh drain electrode DE7 of the seventh transistor T7 is connected to the second initialization voltage source VI2.

Referring to FIGS. 13, 16 and 17, the first initialization voltage line V1_1 is extended along the first direction DR1 from the pixel area PXA, and is also extended in the peripheral area PPA generally along the first direction DR1. When viewed from the top, the first initialization voltage line V1_1 is spaced apart from the scan lines S by a predetermined distance and at least a part thereof is extended in parallel with the scan lines S.

The first initialization voltage line V1_1 is disposed on the gate insulating layer GI in the pixel area PXA. The first initialization voltage lines V1_1 may include in the peripheral area PPA a first portion V1*a*_1 disposed on the gate insulating layer GI, and the first initialization voltage source Vint1_1 provided on the first insulating layer IL'. The first initialization voltage source Vint1_1 may include an output terminal protruding from the first initialization voltage source Vint1_1 in a direction inclined with respect to the first direction DR1.

As only one initialization voltage source Vint1_1 is connected to the pixel PXL, only one initialization voltage line V1_1 is provided or formed along the first direction DR1. As a result, the dead space near the corner of the pixel area PXA can be further reduced.

When only one initialization voltage line V1_1 is provided or formed, the total planar area occupied by the plurality of wires E, S and V1_1 along the second direction DR2 is reduced compared to the structure where two initialization voltage lines are provided or formed. Accordingly, the scan driver SDV and the emission driver EDV may be disposed generally on the upper side of the corner of the pixel area PXA.

That is to say, as the data lines D have a fan-out structure in which the length of the data lines D increases along the first direction DR1 as a distance to the lower side of the corner of the pixel area PXA decreases, the dead space can be further reduced as the scan driver SDV and the emission driver EDV are disposed on the upper side of the corner of the pixel area PXA.

What is claimed is:

1. A display device comprising:

a substrate comprising:

a pixel area including a pixel;

a peripheral area adjacent to the pixel area; and a boundary between the pixel area and the peripheral area, the boundary comprising a rounded corner;

a data driver in the peripheral area;

a data line through which a data signal is provided from the data driver to the pixel, the data line extended along the rounded corner of the boundary between the pixel area and the peripheral area; and an initialization voltage source in the peripheral area and connected to the pixel, the initialization voltage source facing the data line along a thickness direction and extended along the data line which is extended along the rounded corner of the boundary between the pixel area and the peripheral area.

2. The display device of claim 1, wherein the peripheral area of the substrate comprises a terminal area and a portion which connects the terminal area to the pixel area, the terminal area is bendable with respect to a remainder of the peripheral area, and the substrate which is bent disposes the terminal area overlapping the portion of the peripheral area which connects the terminal area to the pixel area, along the thickness direction.

3. The display device of claim 2, wherein the data driver is in the terminal area of the peripheral area.

4. The display device of claim 1, wherein the data line is provided in plural comprising a plurality of data lines having a fan-out structure which spreads out in a direction from the data driver toward the pixel area.

5. The display device of claim 4, wherein the initialization voltage source overlaps the plurality of data lines having the fan-out structure.

6. The display device of claim 1, wherein the initialization voltage source is provided in plural comprising a first initialization voltage source and a second initialization voltage source in the peripheral area, and along the rounded corner of the boundary between the pixel area and the peripheral area, the first initialization voltage source and the second initialization voltage source are arranged parallel to each other at a constant spacing therebetween.

7. The display device of claim 1, further comprising a gate insulating layer, a first insulating layer, a second insulating layer and a third insulating layer in order from the substrate, wherein the initialization voltage source is provided in plural comprising a first initialization voltage source and a second initialization voltage source in the peripheral area.

8. The display device of claim 7, wherein the first insulating layer is between the gate insulating layer and the first initialization voltage source, and between the gate insulating layer and the second initialization voltage source.

9. The display device of claim 7, further comprising:

a first initialization voltage line connected to the pixel area and extended into the peripheral area from the pixel area, and in the peripheral area, a first bridge line which connects the first initialization voltage source to the first initialization voltage line.

10. The display device of claim 9, wherein the second insulating layer is between the first bridge line and the first initialization voltage source, and defines a first contact hole, the first insulating layer and the second insulating layer are between the first bridge line and the first initialization voltage line, and define a second contact hole, the first bridge line is connected to the first initialization voltage source at the first contact hole, and the first bridge line is connected to the first initialization voltage line at the second contact hole.

11. The display device of claim 10, wherein the second initialization voltage source comprises an output terminal protruding toward the pixel area.

12. The display device of claim 11, further comprising a second initialization voltage line connected to the pixel area and extended into the peripheral area from the pixel area, wherein the first insulating layer is between the output terminal of the second initialization voltage source and the second initialization voltage line, and defines a third contact hole, and the output terminal of the second initialization voltage source is connected to the second initialization voltage line at the third contact hole.

13. The display device of claim 10, wherein the data line is provided in plural comprising a first data line and a second data line each in the peripheral area, and in the peripheral area, the gate insulating layer is between the first data line and the second data line, and the second data line is between the gate insulating layer and the substrate.

14. The display device of claim 13, wherein in the peripheral area, along the rounded corner of the boundary between the pixel area and the peripheral area, the first data line and the second data line are extended parallel to each other.

15. The display device of claim 14, wherein the first data line is provided in plural comprising first data lines and the second data line is provided in plural comprising second data lines, and in the peripheral area, the first data lines and the second data lines are alternately arranged.

16. The display device of claim 1, further comprising a scan driver and an emission driver in the peripheral area.

17. The display device of claim 16, wherein the scan driver is between the emission driver and the pixel area.

18. The display device of claim 17, wherein the initialization voltage source is between the scan driver and the pixel area.

19. The display device of claim 16, further comprising:

a first portion of an emission control line connected to the pixel area and extended into the peripheral area from the pixel area, a second portion of the emission control line connected to the emission driver, and a second bridge line which connects the first portion of the emission control line and the second portion of the emission control line to each other.

20. The display device of claim 16, further comprising:

a first portion of a scan line connected to the pixel area and extended into the peripheral area from the pixel area, a second portion of the scan line connected to the scan driver, and a third bridge line which connects the first portion of the scan line and the second portion of the scan line to each other.

21. The display device of claim 1, wherein the substrate further comprises a rounded corner corresponding to the rounded corner of the boundary between the pixel area and the peripheral area, and the initialization voltage source and the data line which is overlapped by the initialization voltage source are each between the rounded corner of the substrate and the rounded corner of the boundary between the pixel area and the peripheral area.

* * * * *